US006712160B1

(12) United States Patent
Schultz et al.

(10) Patent No.: US 6,712,160 B1
(45) Date of Patent: Mar. 30, 2004

(54) LEADLESS SUB ASSEMBLY FOR DOWNHOLE DETECTION SYSTEM

(75) Inventors: Roger L. Schultz, Aubrey, TX (US); Orlando De Jesus, Stillwater, OK (US); Andrew J. Osborne, Jr., Dallas, TX (US)

(73) Assignee: Halliburton Energy Services Inc., Houston, TX (US)

( * ) Notice: Subject to any disclaimer, the term of this patent is extended or adjusted under 35 U.S.C. 154(b) by 59 days.

(21) Appl. No.: 10/040,294

(22) Filed: Oct. 26, 2001

Related U.S. Application Data

(60) Provisional application No. 60/247,263, filed on Nov. 7, 2000, provisional application No. 60/246,681, filed on Nov. 7, 2000, provisional application No. 60/246,656, filed on Nov. 7, 2000, and provisional application No. 60/247,042, filed on Nov. 7, 2000.

(51) Int. Cl.[7] ..... E21B 10/00
(52) U.S. Cl. ..... 175/48; 166/250.01; 340/853.2
(58) Field of Search ..... 175/40, 48; 166/250.01; 340/853.1–853.3

(56) References Cited

U.S. PATENT DOCUMENTS

| | | | |
|---|---|---|---|
| 2,560,328 A | | 7/1951 | Bielstein |
| 2,582,312 A | | 1/1952 | Del'Homme |
| 3,011,566 A | | 12/1961 | Graham |
| 3,058,532 A | | 10/1962 | Alder |
| 3,062,302 A | | 11/1962 | Toth et al. |
| 3,363,702 A | | 1/1968 | Bielstein |
| 3,578,092 A | | 5/1971 | Tesch et al. |
| 3,581,564 A | | 6/1971 | Young |
| 3,678,883 A | | 7/1972 | Fischer |
| 3,703,096 A | | 11/1972 | Vitter et al. |
| 3,714,822 A | | 2/1973 | Lutz |
| 3,728,919 A | | 4/1973 | Scott |
| 3,774,445 A | | 11/1973 | Rundell et al. |
| 3,782,190 A | | 1/1974 | Pittman |
| 3,818,227 A | | 6/1974 | Fries |
| 3,853,087 A | | 12/1974 | Aldag |
| 3,853,184 A | | 12/1974 | McCullough |
| 3,865,736 A | | 2/1975 | Fries |
| 3,906,434 A | | 9/1975 | Lamel |
| 3,913,686 A | | 10/1975 | Manson |
| 3,970,877 A | | 7/1976 | Russell |
| 4,001,773 A | | 1/1977 | Lamel et al. |
| 4,030,558 A | | 6/1977 | Morris |
| 4,040,003 A | | 8/1977 | Beynet et al. |
| 4,063,786 A | | 12/1977 | Rall |
| 4,074,575 A | | 2/1978 | Bergman et al. |
| 4,114,704 A | | 9/1978 | Maurer et al. |
| 4,148,271 A | | 4/1979 | Majernik |
| 4,150,568 A | | 4/1979 | Berger |
| 4,346,591 A | * | 8/1982 | Evans |
| 4,379,291 A | | 4/1983 | Hubbard et al. |
| 4,407,017 A | | 9/1983 | Zhilikov |
| 4,425,010 A | | 1/1984 | Bryant et al. |
| 4,436,164 A | | 3/1984 | Garner |
| 4,441,244 A | | 4/1984 | Cason |
| 4,491,738 A | | 1/1985 | Kamp |
| 4,493,042 A | | 1/1985 | Shima et al. |

(List continued on next page.)

FOREIGN PATENT DOCUMENTS

| | | |
|---|---|---|
| EP | 0909008 A2 | 4/1999 |
| EP | 0909008 A3 | 4/1999 |
| GB | 2153410 A | 1/1985 |
| GB | 2 363 146 A | 12/2001 |
| GB | 2 365 899 A | 2/2002 |
| JP | 360079261 A | 5/1985 |

*Primary Examiner*—Roger Schoeppel
(74) *Attorney, Agent, or Firm*—Robert O. Groover

(57) ABSTRACT

A drill string is equipped with a down hole sub assembly which contains sensors to detect equipment condition during drilling. The sub assembly has no electrical communication with the drill bit itself, and the sensors detect drill bit condition from vibrations or strain or other detectable phenomena. Sensors in the bit itself are not needed.

19 Claims, 37 Drawing Sheets

U.S. PATENT DOCUMENTS

| | | | | |
|---|---|---|---|---|
| 4,548,280 | A | | 10/1985 | Daly et al. |
| 4,562,559 | A | | 12/1985 | Sharp et al. |
| 4,610,313 | A | | 9/1986 | Daly et al. |
| 4,627,276 | A | | 12/1986 | Burgess |
| 4,655,300 | A | | 4/1987 | Davis, Jr. |
| 4,659,043 | A | | 4/1987 | Gallagher |
| 4,665,393 | A | | 5/1987 | Wilder et al. |
| 4,685,329 | A | | 8/1987 | Burgess |
| 4,688,647 | A | | 8/1987 | Daly |
| 4,721,172 | A | * | 1/1988 | Brett et al. |
| 4,730,681 | A | | 3/1988 | Estes |
| 4,773,263 | A | | 9/1988 | Lesage et al. |
| 4,785,894 | A | | 11/1988 | Davis et al. |
| 4,785,895 | A | | 11/1988 | Davis et al. |
| 4,790,190 | A | | 12/1988 | Bambara et al. |
| 4,812,826 | A | | 3/1989 | Kaufman et al. |
| 4,818,153 | A | | 4/1989 | Strandell et al. |
| 4,821,563 | A | | 4/1989 | Maron |
| 4,849,741 | A | | 7/1989 | Thomas |
| 4,852,399 | A | | 8/1989 | Falconer |
| 4,876,886 | A | | 10/1989 | Bible et al. |
| 4,884,071 | A | * | 11/1989 | Howard |
| 4,903,245 | A | | 2/1990 | Close et al. |
| 4,911,252 | A | | 3/1990 | Estes |
| 4,926,686 | A | | 5/1990 | Fay |
| 4,926,950 | A | | 5/1990 | Zijsling |
| 4,928,521 | A | | 5/1990 | Jardine |
| 4,958,125 | A | | 9/1990 | Jardine et al. |
| 5,001,993 | A | | 3/1991 | Gramlow |
| 5,072,611 | A | | 12/1991 | Budd et al. |
| 5,138,875 | A | | 8/1992 | Booer |
| 5,140,311 | A | | 8/1992 | Cook |
| 5,141,061 | A | | 8/1992 | Henneuse |
| 5,151,882 | A | * | 9/1992 | Kingman |
| 5,159,577 | A | | 10/1992 | Twist |
| 5,183,123 | A | | 2/1993 | White |
| 5,216,917 | A | | 6/1993 | Detournay |
| 5,226,332 | A | | 7/1993 | Wassell |
| 5,249,871 | A | | 10/1993 | LaTorre et al. |
| 5,251,144 | A | * | 10/1993 | Ramamurthi |
| 5,305,836 | A | | 4/1994 | Holbrook et al. |
| 5,321,981 | A | | 6/1994 | Macpherson |
| 5,353,873 | A | | 10/1994 | Cooke, Jr. |
| 5,372,207 | A | | 12/1994 | Naville et al. |
| 5,407,265 | A | | 4/1995 | Hamidieh |
| 5,415,030 | A | | 5/1995 | Jogi et al. |
| 5,448,911 | A | * | 9/1995 | Mason |
| 5,602,437 | A | | 2/1997 | Shahamat et al. |
| 5,633,628 | A | | 5/1997 | Denny et al. |
| 5,677,488 | A | | 10/1997 | Monahan et al. |
| 5,679,894 | A | | 10/1997 | Kruger |
| 5,691,707 | A | | 11/1997 | Smith et al. |
| 5,794,720 | A | | 8/1998 | Smith et al. |
| 5,813,480 | A | | 9/1998 | Zaleski, Jr. |
| 5,839,508 | A | | 11/1998 | Tubel |
| 5,864,058 | A | | 1/1999 | Chen |
| 5,865,543 | A | | 2/1999 | MacLean |
| 5,947,213 | A | * | 9/1999 | Angle et al. |
| 6,011,346 | A | | 1/2000 | Buchanan |
| 6,068,394 | A | | 5/2000 | Dublin, Jr. |
| 6,151,554 | A | | 11/2000 | Rodney |

* cited by examiner

LEADLESS SUB ASSEMBLY FOR DOWNHOLE DETECTION SYSTEM

CROSS-REFERENCE TO OTHER APPLICATION

This application claims priority from U.S. provisional applications Nos. 60/247,263, 60/246,681, 60/246,656 and 60/247,042, all filed Nov. 07, 2000 and all hereby incorporated by reference.

The present application has some Figures in common with, but is not necessarily otherwise related to, the following applications(s), which are commonly owned with and have the same effective filing as the present application and which are all hereby incorporated by reference:
application Ser. No. [10/040,927] filed [Oct. 26, 2001];
application Ser. No. [10/035,350] filed [Oct. 26, 2001];
application Ser. No. [10/040,304] filed [Oct. 26, 2001];
application Ser. No. [10/040,928] filed [Oct. 26, 2001]; and
application Ser. No. [10/036,105] filed [Oct. 17, 2001].

BACKGROUND AND SUMMARY OF THE INVENTION

The present invention relates to systems, methods, and subassemblies for drilling oil, gas, and analogous wells, and more particularly to downhole failure detection.

Background: Downhole Bit Failure

When drilling a well it is desirable to drill as long as possible without wearing the bit to the point of catastrophic bit failure. Optimum bit use occurs when a bit is worn sufficiently that the useful life of the bit has been expended, but the wear is not so extensive that there is a high likelihood of mechanical failure which might result in leaving a portion of the bit in the well. Poor drilling performance, increased BHA (Bottom Hole Assembly) wear, and more frequent fishing jobs all result from continued drilling with bits which are in the process of mechanical failure. A system capable of detecting the early stages of bit failure, with the additional capability of warning the operator at the surface, would be of great value solving the problem of drilling to the point of catastrophic bit failure.

The innovations in this application provide a reliable, inexpensive means of early detection and operator warning when there is a roller cone drill bit failure. This system is technically and economically suitable for use in low cost rotary land rig drilling operations as well as high-end offshore drilling. The solution is able to detect impending bit failure prior to catastrophic damage to the bit, but well after the majority of the bit life is expended. In addition to failure detection, the innovative system is able to alert the operator at the surface once an impending bit failure is detected.

The problem of downhole bit failure can be broken down into two parts. The first part of the problem is to develop a failure detection method and the second part of the problem is to develop a method to warn the operator at the surface. Several approaches for detecting bit failure have been considered.

It appears that some work has been done on placing sensors directly in the drill bit assembly to monitor the bit condition. There is some merit in placing sensors in the bit assembly, but this methodology also has some distinct disadvantages. The main disadvantage is the necessity of redesigning every bit which will use the method. In addition to being costly, each new bit design will have to accommodate the embedded sensors which might compromise the overall design. A second disadvantage arises from the fact that sensor connections and/or data transmission must be made across the threaded connection on the bit to a data processing or telemetry unit. This is difficult in practice.

Downhole Power

In any system that uses electronic components there must be a power source. In many downhole tools disposable batteries are used to power electronics. Batteries have the desirable characteristics of high power density and ease of use. Batteries that are suitable for high-temperature, downhole use have the undesirable characteristics of high cost and difficulty of disposal. Batteries are often the only solution for powering downhole tools requiring relatively high power levels.

Leadless Sub Assembly

In a preferred embodiment, a drill string has a bottom hole assembly that includes an instrumented sub located above the drill bit. The sub assembly preferably has sensors therein to detect phenomena relating to drill bit condition. (Note that the present innovations can also be applied to other problems besides determining drill bit condition.) In the preferred embodiment, the sub assembly has no electrical communication with the drill bit and no sensors are needed in the drill bit. For example, one embodiment uses vibration detecting sensors to characterize the vibrational frequency of the drilling apparatus. Changes in this vibration, which can indicate drill bit failure, can be detected from the sub assembly without need for sensors or electrical leads to the drill bit.

The disclosed innovations, in various embodiments, provide one or more of at least the following advantages:

- no special bit required;
- compatibility with bits from any manufacturer;
- design-independent prediction of bit failure;
- easily updated and improved by running different filter algorithms, or different error-detection criteria in parallel, on real-time or simulated data;
- adaptable to varying drilling conditions;
- early detection of bit failure reduces fishing; and
- early detection of bit failure permits greatly improved failure analysis (since bits can be pulled in time for informative routine analysis, without significant loss of running time) and hence rapid improvements in bit design.

BRIEF DESCRIPTION OF THE DRAWING

The disclosed inventions will be described with reference to the accompanying drawings, which show important sample embodiments of the invention and which are incorporated in the specification hereof by reference, wherein:

FIG. 54 shows a basic linear network.

DETAILED DESCRIPTION OF THE PREFERRED EMBODIMENTS

The numerous innovative teachings of the present application will be described with particular reference to the presently preferred embodiment (by way of example, and not of limitation).

Further Background: Adaptive Filters (Neural Networks)

Figure 52:
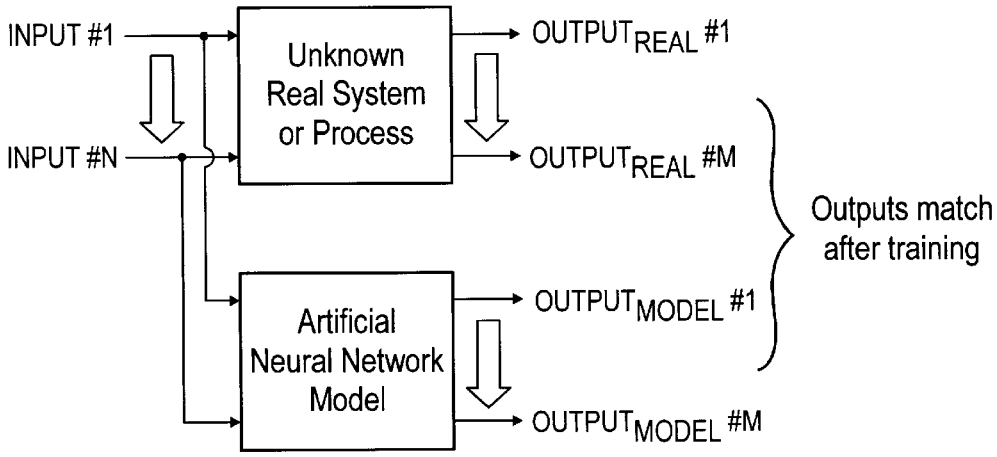
FIG. 52 shows a neural net modeling a real system.

A neural network can be generally described as a very flexible nonlinear multiple input, multiple output mathematical function which can be adjusted or "tuned" in an organized fashion to emulate a system or process for which an input/output relationship exists. For a given set of input/output data, a neural network is "trained" until a particular input produces a desired output which matches the response of the system which is being modeled. After a network is trained, inputs which are not present in the training data set will produce network outputs which closely match the corresponding outputs of the actual system under the same inputs. FIG. 52 illustrates the process.

Neural networks can be devised to produce binary (1/0, yes/no), or continuous outputs. One idea is that a mathematical model, which describes a possibly very complex input/output relationship, can be constructed with little or no understanding of the input/output relationship involved in the actual system. This ability provides a very powerful tool, which can be used to solve a variety of problems in many fields.

Background: Artificial Intelligence (Smart System) Applications

Artificial intelligence (where human expertise or behavior is captured and used in decision making, design optimization, or other complex qualitative human thinking) is one type of application in which neural networks have been used successfully. In these applications the goal is usually to capture some human expertise which is typically hard to quantify in terms of exact numerical terms. One example of this is in the design of printed circuit boards. There are many software packages which use numerical optimization techniques to automatically place components and route traces in an electronic circuit board design. The most successful of these software packages use a neural network-based auto-router to perform the automatic design generation. In developing this software, a great number board designs from the best printed circuit board designers in the world were used to train the neural network-based auto-router. In this way the very best human capabilities which were developed through many years of circuit board design experience were captured to produce the best automatic routing software on the market. This is only one of many examples in which some human quality, skill or capability has been captured using a neural network so the expertise can be used by others. There are almost certainly many applications of this type in the oil field service industry. A few examples might include: well log interpretation, drilling operations decision making, reservoir data interpretation, production planning, etc. In these application the network output usually appears in the form of a yes/no answer, or a confidence factor that a particular condition or state in a system exists. This is in contrast to a hard numerical output that can be used to quantify some property or state in the system being modeled.

Background: Function Approximation Applications

Neural networks are most commonly used in what are known as function approximation problems. In this type of application a neural network is trained using experimental data to produce a mathematical function which approximates an unknown real system. This capability provides a very useful engineering tool particularly when the system is a multiple-input, and/or multiple-output system. Again, it must be stressed that a very attractive feature of a neural network model is that very little and sometimes no understanding of the physical relationship between a measured system output and the system input is required. The only real requirement is that sufficient training data is available, and that a complex enough neural network structure is used to model the real system.

Nonlinear transducer calibration is a common function approximation application for neural networks. Many times a transducer output is affected by temperature. This means there are actually two inputs which each have an effect on the output of the transducer. In the case of a pressure transducer, both temperature and pressure change the output of the transducer. Sometimes the pressure and temperature response of the transducer can be very nonlinear. So in this case we have two inputs which are nonlinear which affect the output which somehow must be related to the state in the system we are interested in which is pressure. This nonlinear transducer would be a very good candidate for neural network calibration. In order to use a neural network to calibrate the transducer output the transducer would need to be placed inside a controlled calibration bath in which temperature and pressure could be varied over the range in which the transducer is to be used. As the pressure and temperature are varied the actual temperature and pressure of the bath must be carefully recorded along with the corresponding transducer outputs. This recorded data could then be used to form the input/output data needed to train the neural network which could then be used to correct the raw transducer readings.

This same concept can be applied to situations where it is possible to take several measurements in a system which are somehow related to a state in the system which may be extremely difficult to measure. In this case many different transducer measurements could be combined to estimate the state which is hard or expensive to measure. An example of this might be an application in which an extremely high oven temperature must be known, but the harshness of the environment precludes reliable long-term temperature measurement inside the oven. One solution might be to use external temperature transducers in combination with some sort of optical transducer which detects light energy within the oven from a safe distance. All the transducer inputs could then be combined with measured oven temperature data to train a neural network to estimate the internal oven temperature based on the external transducer measurements.

Another type of function approximation problem in which neural networks are often well suited is in inverse function approximation. In this type of problem an input/output relationship is known or can be numerically simulated using Monte-Carlo or similar computer intensive simulation techniques. This data can then be used to train a neural network to approximate the inverse of this function. In other words, instead of only knowing the system outputs for a given set of inputs, the system inputs can be determined using a set of outputs. This may seem strange at first, but it can be very useful. For example, consider a logging tool in which transducer measurements are used to estimate some formation property or set of properties. In this case, it may be possible to simulate or experimentally measure the transducer outputs for a range of formation properties. This data could then be used to construct an inverse neural network model which describes the formation properties which produce particular transducer outputs. This can be a powerful modeling tool provided that the system has an inverse. In some cases there is a unique forward mapping, but no unique inverse mapping.

Background: Signal Processing Applications

Adaptive signal processing is another area where neural networks can be used with great effectiveness. Transmitted signals are often contaminated with unwanted noise. Sometimes the noise enters a signal at the transducer, and sometimes the noise enters a transmission channel as electromagnetic interference. Many times the contaminating noise is due to a repetitive noise source. For example, internal combustion engines are notoriously loud, but generate sound that is repetitive in nature. In fact, repetitive noise is present in most fans, generators, power tools, hydraulic systems, mechanical drive trains, and vehicles. Classical filtering of these noise sources is not possible because many times these noises appear in the same frequency range as the communication carrier frequency etc. A technique known as adaptive signal processing may be used to remove periodic and semi-periodic noise from a signal. In this method a mathematical model is used to predict the incoming signal value shortly before is arrives. A neural network can be used as the mathematical prediction model. In this case a multiple inputs neural network is used. Past values of the signal are used to predict future signal values in advance. This prediction is then subtracted from the corrupted noisy signal at the next instant in time. Because the periodic noise is more predictable than the desired component contained in the noisy signal, the unwanted noise is removed from the corrupted signal leaving the desired signal. The adaptation speed of the filter can be adjusted so that the desired portion of the signal is not filtered away. After the unwanted noise is removed the "clean" signal which has been extracted from the noisy signal is recovered. A filter which is adaptive must be used because noise source and the physical environment around the system are subject to change. For this reason the adaptive model must change to model the noise source and transmission environment.

Sometimes the undesirable noise in an environment is random in nature. In this case, again an adaptive filter may be used to filter out the random or colored noise. For random noise the adaptive filter is used differently. The adaptation speed is maximized so that the desired component in a noisy signal is predicted by the filter. The random components in the signal cannot be predicted, so the prediction contains only the non-random components in the signal. In the case only the prediction is then presented as the recovered signal. This prediction will contain only non-random components which would include the signals of many telemetry schemes.

There are many types of adaptive filters which may be used. The most common filter structure is a linear structure known as the adaptive finite impulse response (FIR) filter structure. Because of the linear nature of this filter structure it can only be used to approximate nonlinear signal sources and sound environments. For this reason a more sophisticated nonlinear filter structure can exhibit higher filtering performance than a simple linear filter. Recent developments in digital signal processing equipment have made it possible to consider using adaptive neural network filters. These filters are computationally burdensome to implement in real-time, and it has just recently become practical to use them in this manner. Neural network models can be very nonlinear in nature making them very flexible in being able to monitor real systems which often contain nonlinearities. Real environments are often very nonlinear. For this reason adaptive neural network filters are more effective than conventional linear adaptive filters.

Figure 53:
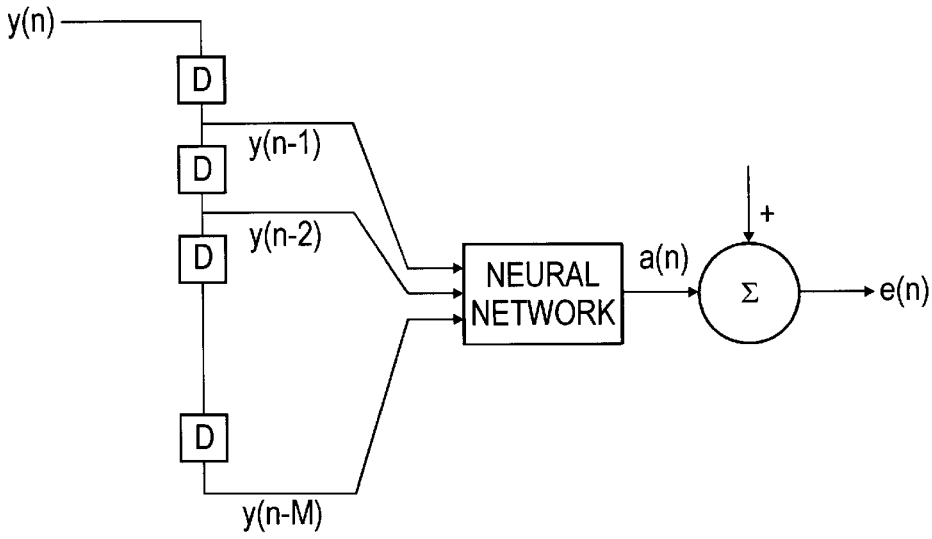
FIG. 53 shows a non-recurrent real-time neural network.
Figure 53:
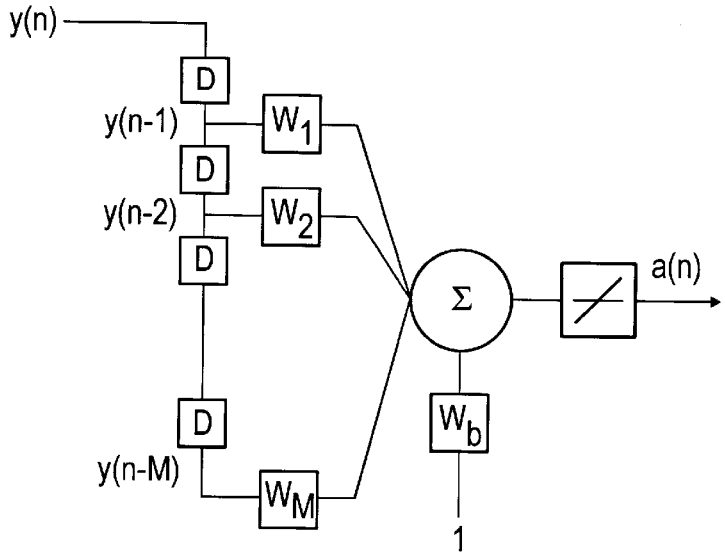

Network training is accomplished, e.g., using an approximate steepest descent method. At each time step the measured error is used to calculate a local gradient estimation which is used to update the network weights. For networks which are non-recurrent (i.e., having no feedback), standard back propagation may be used to calculate the necessary gradient terms used in training. FIG. 53 shows a basic non-recurrent network as well as the system inputs, outputs, and measurements which are used in training the network. The network could have multiple input channels and output channels. The error e(n) in FIG. 53 is the difference between the desired network output, and the actual network output. In a predictive signal filtering system the prediction error is calculated by subtracting the predicted future value from the actual measured value after it arrives. This error measurement is used to adjust the neural network weights to minimize the prediction error. Neural networks can be linear or nonlinear in nature. FIG. 54 shows a basic linear network. In this network the output is a weighted sum of the past inputs to the network. The samples y(n−1), y(n−2), . . . represent past values of the signal being filtered.

Figure 55:
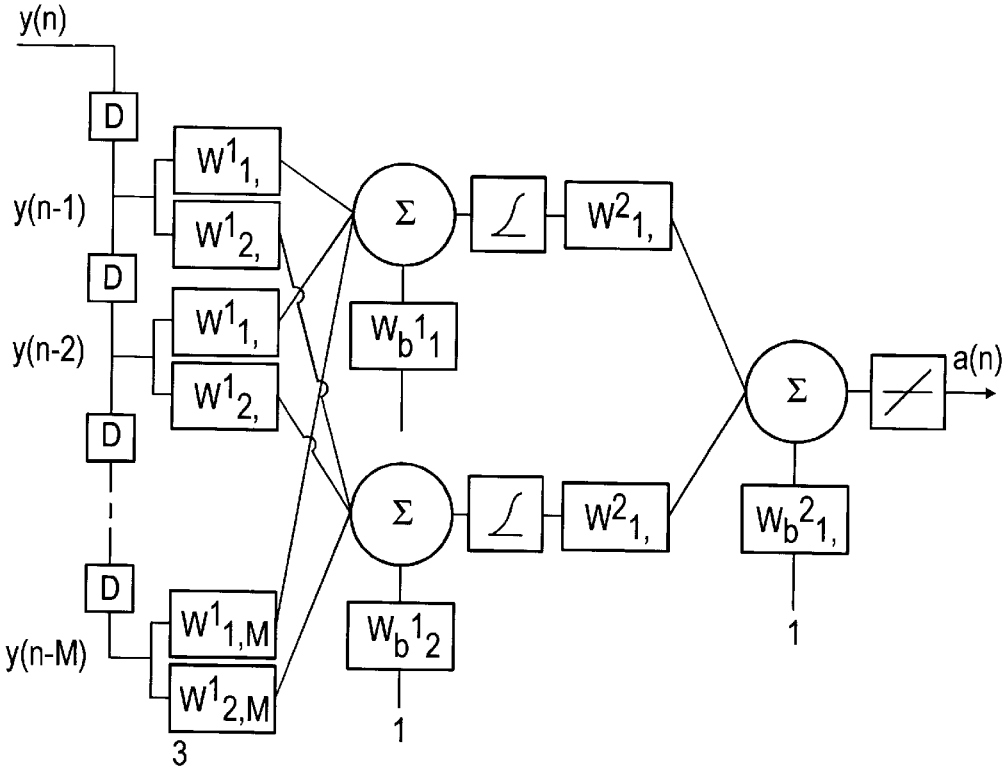
FIG. 55 shows a nonlinear feedforward network.

FIG. 55 shows a nonlinear network. This network has a non-recurrent two layer structure which contains nonlinear log-sigmoid functions of the form:

$$f(n) = \frac{1}{1 + e^{-n}}$$

The structure of neural network filters can be varied in many ways. The number of past samples used, the number of internal activation functions, and the number of internal layers in the network can be varied.

Figure 56:
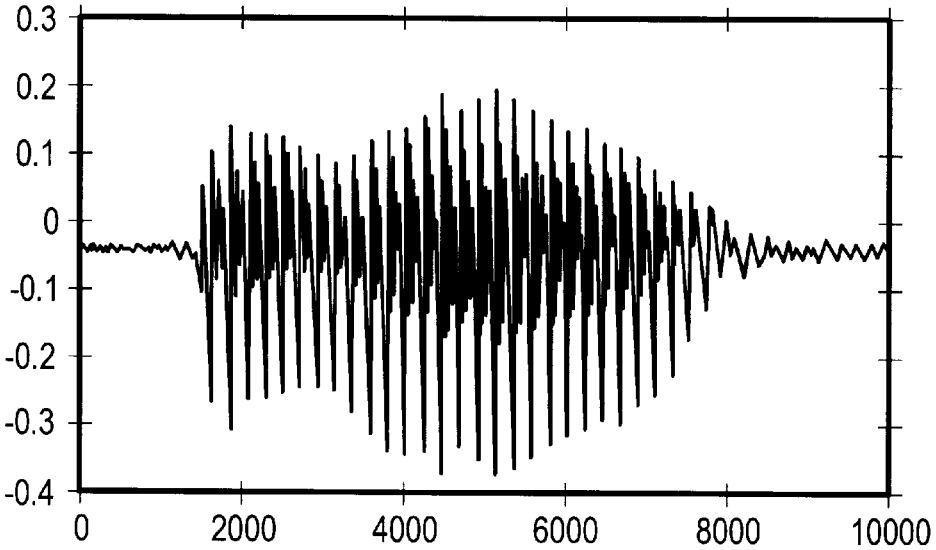
FIG. 56 shows a standard "hello" signal for testing purposes.

To provide an example of adaptive neural network filtering simulation was performed. Simulations were performed using both linear and nonlinear network structures A noise-free recording was made of the word "hello" then contaminated with varying types and levels of noise. The corrupted signal was then filtered and the results examined. FIG. 56 shows the standard "hello" wave form used in all simulations.

Figure 57A:
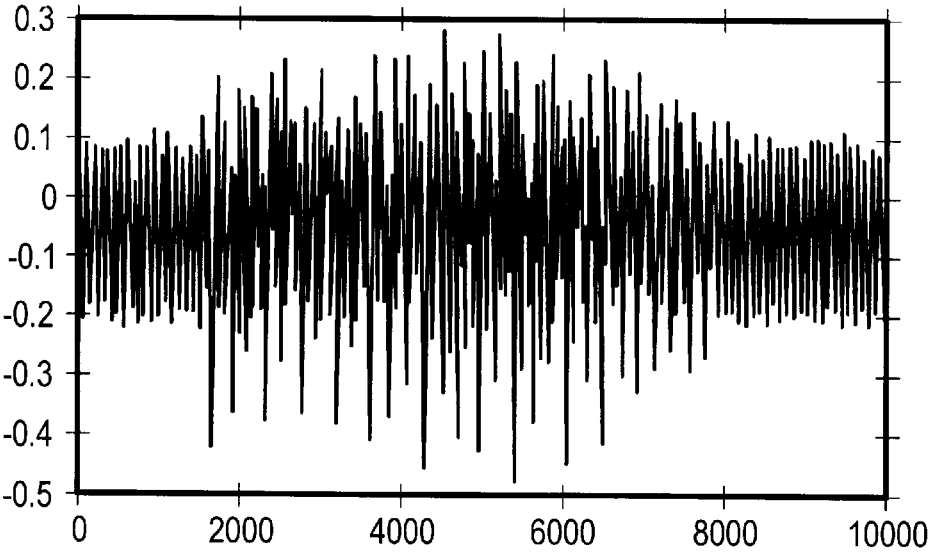
FIG. 57 shows a corrupted and filtered signal of the "hello."
Figure 57B:
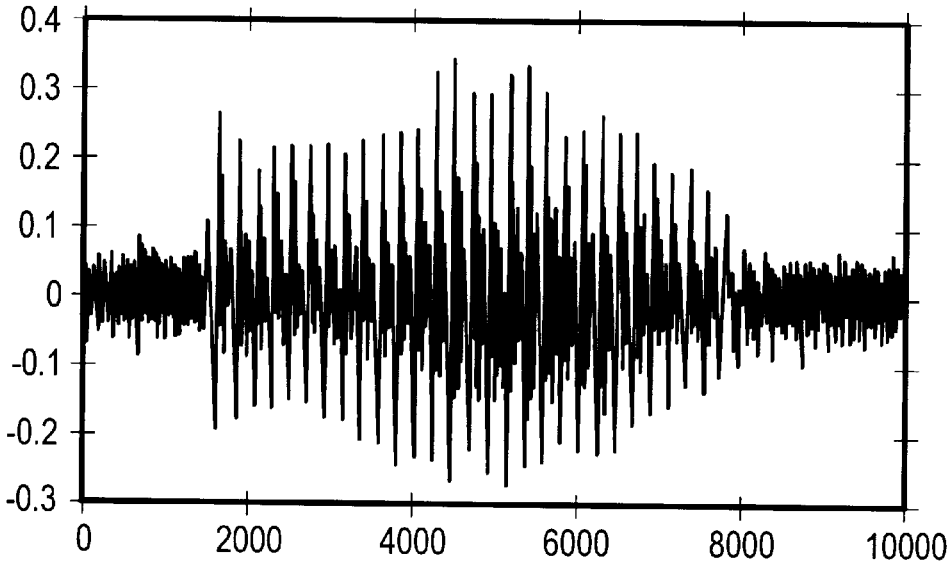
Figure 58A:
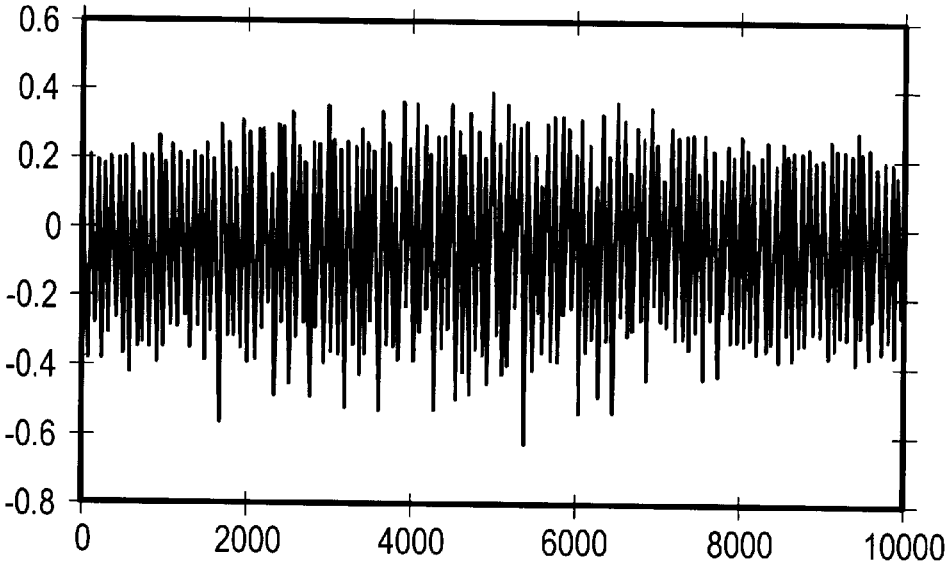
FIG. 58 shows a corrupted and filtered signal of the "hello."
Figure 58B:
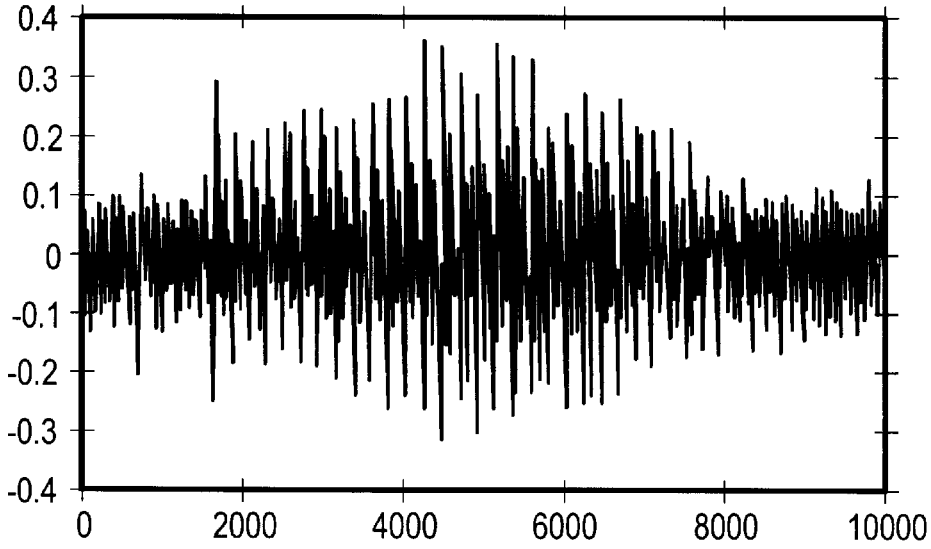
Figure 59A:
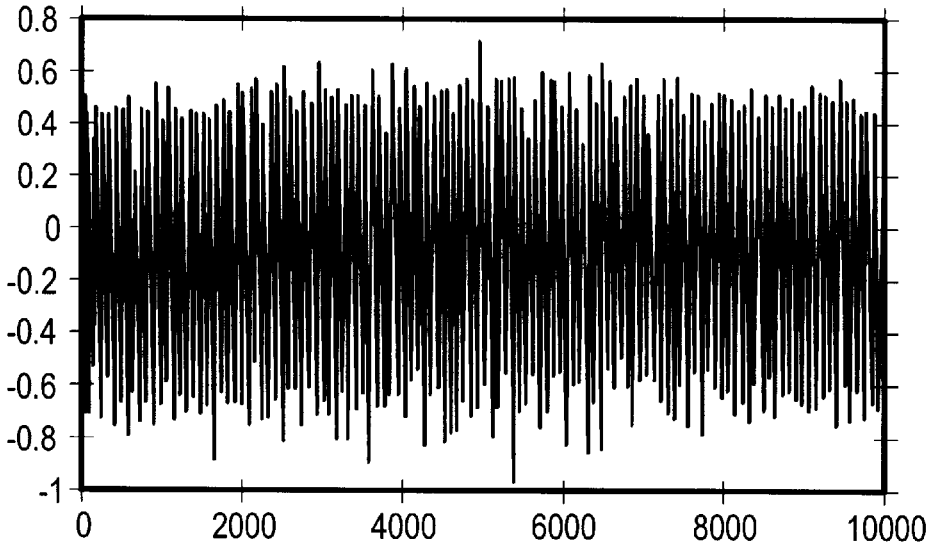
FIG. 59 shows a corrupted and filtered signal of the "hello."
Figure 59B:
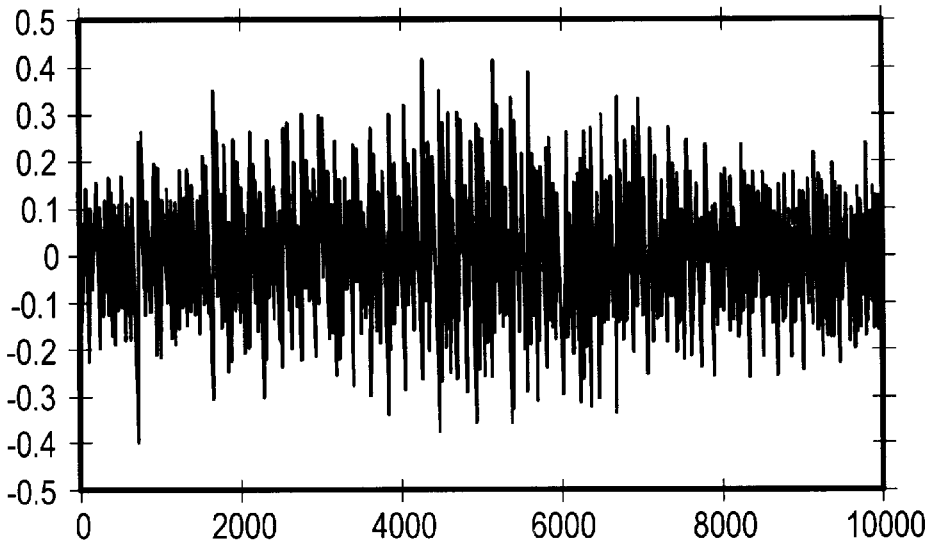

Noise was recorded from a small "shopvac" style wet/dry vacuum cleaner. An analysis of the noise revealed significant random and periodic noise components. FIGS. 57, 58, and 59 show the "Hello" standard corrupted by the recorded noise to varying degrees, and also the recovered signals after filtering using a 70 tap nonlinear neural network having 2 hidden neurons. Significant improvement can be seen even when the signal to noise ratio in the corrupted signal is 0.06 as is indicated in FIG. 59.

Figure 60:
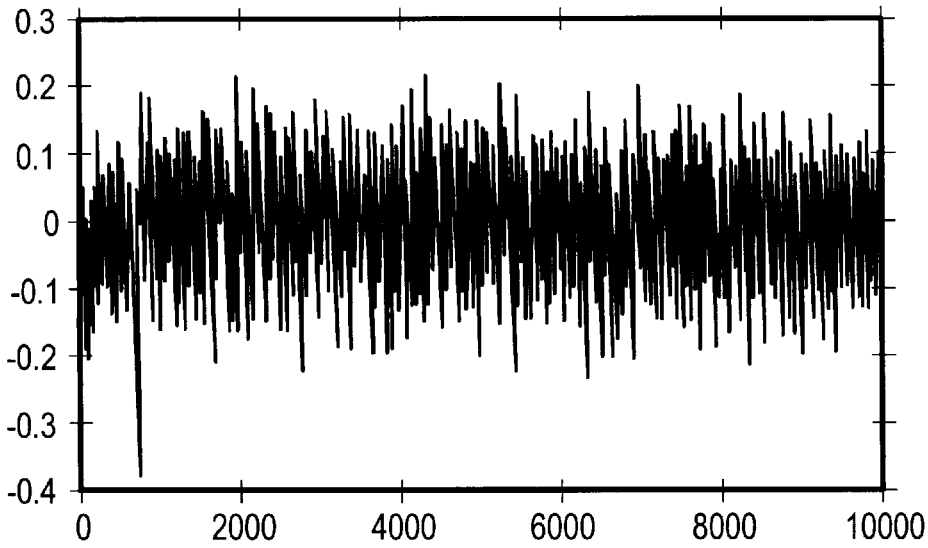
FIG. 60 shows the results of a linear filter.

A standard linear tapped delay line adaptive filter was also implemented. The same input data that appears in FIG. 59 was filtered using a 70 tap linear filter. The results are shown in FIG. 60.

Several variations embodying the present innovations are described below with reference to the numbered figures. Tests were conducted to obtain experimental data to validate the chosen detection methods. In three of these tests bits were run until a failure was obtained. In addition to bit failure detection tests, tests concerned with the generation of power using the vibrations produced by the drilling operation were conducted. A vibrations-driven power generation device was designed, constructed and tested. The purpose of this device is to power the downhole instrumentation, which will be required in the final detection/warning system. The idea here is to eliminate the need for batteries and to allow the electronics chamber to be hermetically sealed.

In one example embodiment, sensors are placed in a sub assembly located above and separate from the drill bit. Data from the sensors in the sub are fed into a filter (e.g., an adaptive neural net). The adaptive filter uses past signal measurements to predict future signal measurements. The difference between the predicted sensor readings and the actual sensor readings is used to compute a prediction error.

The value of the prediction error is used to detect probable bit failure during drilling. Bit failure can be indicated by spikes in the prediction error that exceed a predetermined threshold value with an average frequency of occurrence that also exceeds a threshold frequency value. Alternatively, failure can be indicated when the standard deviation of the predicted error grows large enough. Thus the change in prediction error can indicate bit failure.

In another embodiment, sensors are placed in a sub assembly located above and separate from the drill bit itself. The bit and sub are connected by threading, and no active electrical connections between them are needed. Data from the sensors in the sub are collected and undergo a fast Fourier transform to analyze them in the frequency domain. The spectral power of the signal from each sensor is divided into different frequency bands, and the power distribution within these bands is used to determine changes in the performance of the bit.

The signal power in each frequency band is computed and a ratio of the power in a given band relative to that in another band is computed. For a bit in good working condition, the majority of spectral energy is in lower frequency bands. As a bearing starts to fail, it produces a greater level of vibrational energy in higher frequency bands, as demonstrated in tests. A dramatic change in the relative spectral energies of the sensors occurs when a bearing begins to fail. Therefore, by monitoring these relative power distributions, bit failure can be detected.

Failure can be detected in a number of ways, depending on the particular application and hardware used. As an example, failure can be detected by observing a threshold for the spectral energy distributions. When the spectral energy threshold is exceed a given number of times, or when the threshold is exceeded with a high enough frequency, a failure is indicated.

In another variation, sensors are placed on a separate sub assembly, which detect changes in induced bending and axial stresses which are related to roller cone bearing failure.

Each cone on a bit supports an average percentage of the total load on the bit. As one of the cones begins to fail, the average load it supports changes. This change causes a variation in the bending strain induced by the eccentric loading of the bit. An average value of strain for each of the strain gauges is computed, then divided by a similar average strain value for each of the other strain gauges. This value remains constant in a properly working bit, even if the load on the bit changes. However, as an individual cone wears out and the average percentage of the load changes, the ratio of the average strain at each of the strain gauge locations will change.

Failure can be indicated in a number of ways, for example, when the monitored ratios experience a change that exceeds a predetermined threshold.

In another variation, downhole sensors located in a sub assembly are monitored, and cross comparisons between sensors are performed. Sensors might include temperature, acceleration, or any other type of sensor that will be affected by a bit failure. An absolute sensor reading from any one sensor is not used to determine bit failure. Instead, a measurement of one sensor relative to the other sensors is used.

The changes in sensor readings which do indicate failure are reported to the operator through variations in downhole pressure. The pressure is controlled with a bypass port located above the bit. Opening the port decreases pressure, closing the port restores it. Such changes in pressure are easily detected by the operator.

Other methods of indicating bit failure include placing sensors inside the bit to detect failures, then transmitting via a telemetry system to the surface to warn the operator, or placing a tracer into the bearing grease and monitoring the mud system at the surface to detect the release of the tracer in the event of a bearing seal failure. Both of these methods involve modification of current bit designs, or involve expensive or impractical detection equipment at the surface to complete the warning system.

One method chosen for signaling the surface operator is relatively inexpensive and simple. Upon detection of a bit failure, a port will be opened above the drill bit. This will cause a dramatic decrease in surface pump pressure. This decrease in pressure can easily be detected at the surface and can be used to indicate problems with the bit. If desired, the downhole tool can be designed to open and close repeatedly. In this way it is possible for binary data to be slowly transmitted to the surface by opening and closing the bypass port.

To further simplify operation and to reduce operating costs, consideration has been given to using the downhole vibration produced by drilling to generate the power used to operate the downhole detection/signaling tool electronics. This has the obvious advantage of eliminating the need for batteries. An experimental vibration activated power generation device was built and tested. This device verified that vibrations produced during drilling can be used to generate power.

Methods for Detecting Bit Failure

Three subheadings below classify the many embodiments used to describe several of the innovations within this application. The subheadings are Spectral Power Ratio Analysis (SPRA), Mean Strain Ratio Analysis (MSRA) and Adaptive Filter Prediction Analysis (AFPA). Each method will be presented in detail later in this section. One innovation in failure detection methodology which is herein disclosed can be considered the use of an "indirect" method of detection in which the sensors used to measure signals produced by the bit are located directly above the drill bit in a special sensor/telemetry sub and NOT within the bit itself.

In another example the measurements that are being made are not direct measurements of bearing parameters (i.e. wear, position, journal temperature etc.), but of symptoms of bit failure such as vibration and induced strain above the bit. This type of arrangement has some very desirable features. The most significant advantage of this method over other methods is the characteristic that this method may be used with any bit without modifying the bit design in any way. This effectively separates the bit design from the detection/warning system so the most desirable bit design can be achieved without concern for the accommodation of embedded sensors.

Figure 1:
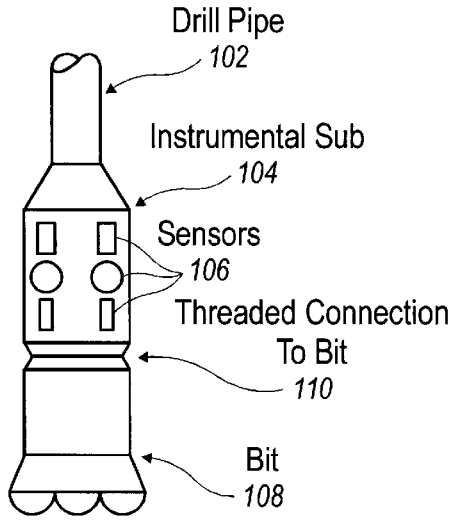
FIG. 1 shows the sensor placement relative to the bit.

FIG. 1 shows the physical arrangement of apparatus relative to the bit. The drill pipe 102 connects to the instrumented sub assembly 104, which contains the sensors 106 and telemetry apparatus for relaying a failure signal to the surface. The sensors are preferably located in the sub assembly in a symmetric fashion, but other embodiments can use asymmetric configurations. The sub assembly is connected to the drill bit 108 through a threaded connection 110. No electrical connections are necessary between the bit and sub in this embodiment.

Spectral Power Ratio Analysis

Figure 2:
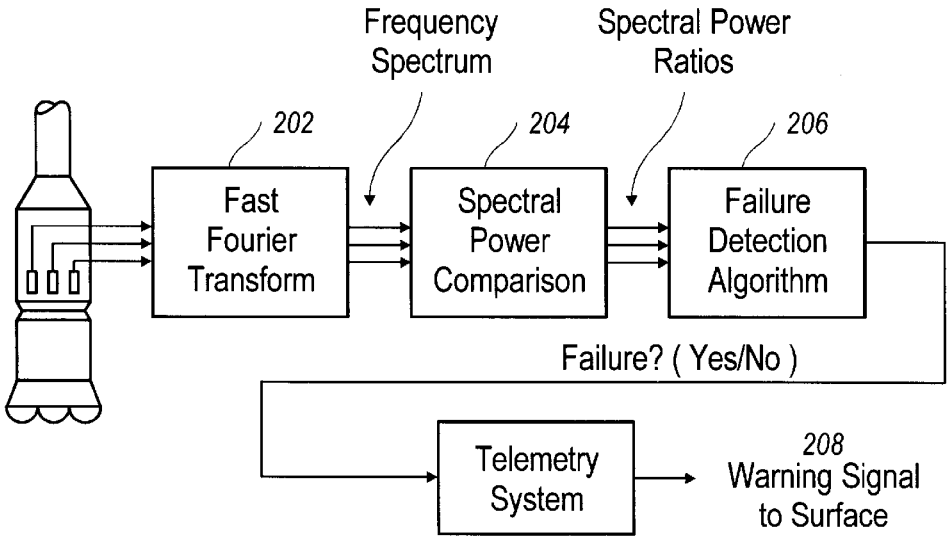
FIG. 2 shows a process flow for the spectral power ratio analysis method.

The first class of embodiments discussed for detecting impending bit failure has been named the Spectral Power Ratio Analysis (SPRA) method. FIG. 2 illustrates the process.

FIG. 2 shows an overview of the process by which failure is detected and indicated to the operator in this class of embodiments. The sensors in the drill assembly include circuitry which performs a fast Fourier transform on the data (step 202) to thereby translate the data into the frequency domain. A spectral power comparison is then performed (step 204) which allows the data to be put into spectral power ratios. A failure detection algorithm (step 206) checks to see if the failure condition(s) is (are) met. If a failure is indicated, the telemetry system relays the failure indication signal to the surface operator (step 208).

In this method sensor data (primarily from accelerometers) is collected in blocks, and then analyzed in the frequency domain. The frequency spectrum of a window of fictitious sensor data is broken up into bands as shown in FIG. 3.

Figure 3:
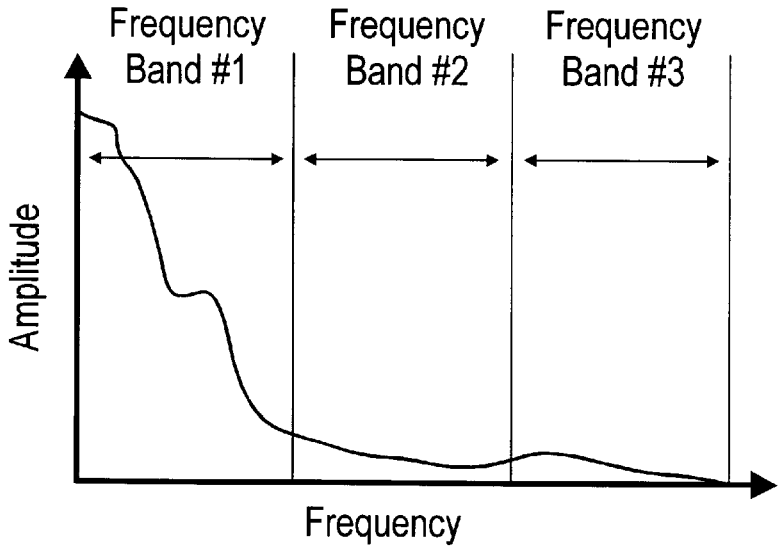
FIG. 3 shows the frequency band arrangement for the spectral power ratio analysis method.

FIG. 3 shows three frequency bands, with frequency plotted along the x-axis, and amplitude plotted on the y-axis. In this figure, the majority of vibrational power is located in the lowest frequency band. The two higher frequency bands have low spectral power relative to the first band. In this figure, the frequency bands are shown to be of the same width, but they can vary in width, and any number of bands can be chosen.

The signal power in each of the frequency bands is then computed and a ratio of the power contained in each of the frequency bands to the power contained in each of the other frequency bands is then computed. The results obtained from processing each block of data are the ratios R1, R2, and R3 which written in equation form are:

$R1$=(Power in band 2)/(Power in band 1)

$R2$=(Power in band 3)/(Power in band 1)

$R3$=(Power in band 3)/(Power in band 2)

Of course, these are example ratios, and other ratios can be used as well. The idea is that when the bearings in a bit are in good mechanical shape most of the spectral energy found in the bit vibration is contained in the lowest frequency band. As a bearing starts to fail it produces a greater level of vibration in the higher frequency bands. This phenomenon has been demonstrated in lab tests as will be shown below. If the frequency band ratios R1, R2 and R3 are constantly monitored, a dramatic change in these ratios will occur when a bit begins to produce high-frequency vibrations ("squeaking") as a bearing begins to fail. The ratios R1 and R2, which involve ratios of the lowest frequency band with the higher frequency bands are in practice the most important indicators of bearing failure. Of course the frequency spectrum of the sensor signals can be broken into more or fewer frequency bands as desired.

Figure 4:
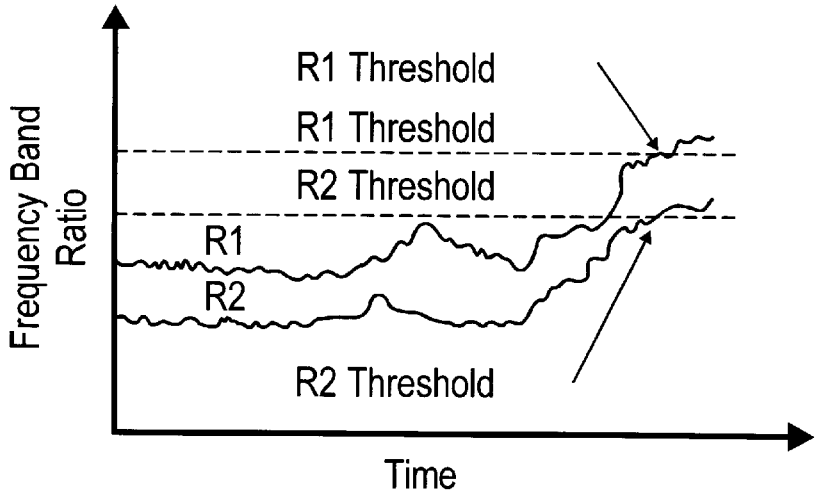
FIG. 4 shows frequency band ratios and thresholds for bit failure detection.

A failure can be detected in at least two ways. The first method is to simply set a threshold value for the frequency band ratios R1, R2 and then monitor the number of times or the frequency with which the threshold is exceeded. After the threshold is exceeded a certain number of times or is exceeded with high enough frequency a bearing failure is indicated. FIG. 4 illustrates this method.

FIG. 4 shows one method of determining failure in the bit. The frequency band ratios R1 and R2 are shown plotted against time. Thresholds are set for R1 and R2. At the locations indicated by arrows, each respective frequency ratio exceeds its threshold, which in some embodiments indicates failure.

Another way of detecting a failure is to monitor the standard deviation of the frequency ratios. When the standard deviation becomes high enough, a failure is indicated.

Figure 5:
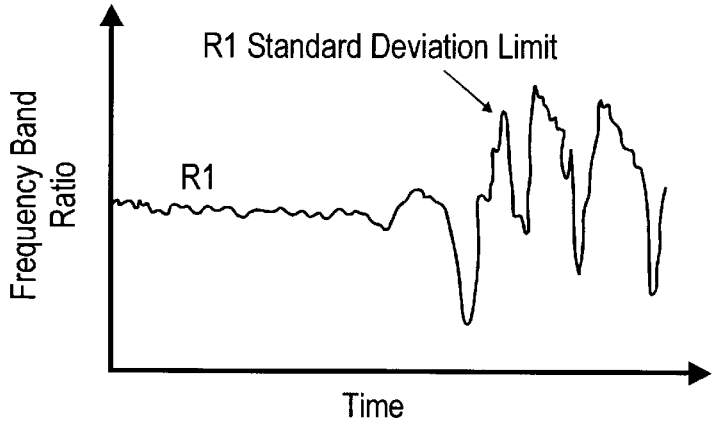
FIG. 5 shows monitoring of standard deviation of frequency ratios to determine bit failure.

FIG. 5 illustrates this method. The figure shows one such frequency ratio, R1. At some point in the plot, the signal begins to vary. Once the standard deviation exceeds a certain limit, a failure is indicated. Alternatively, the failure can be indicated once the standard deviation has been exceed a specific number of times.

Figure 6:
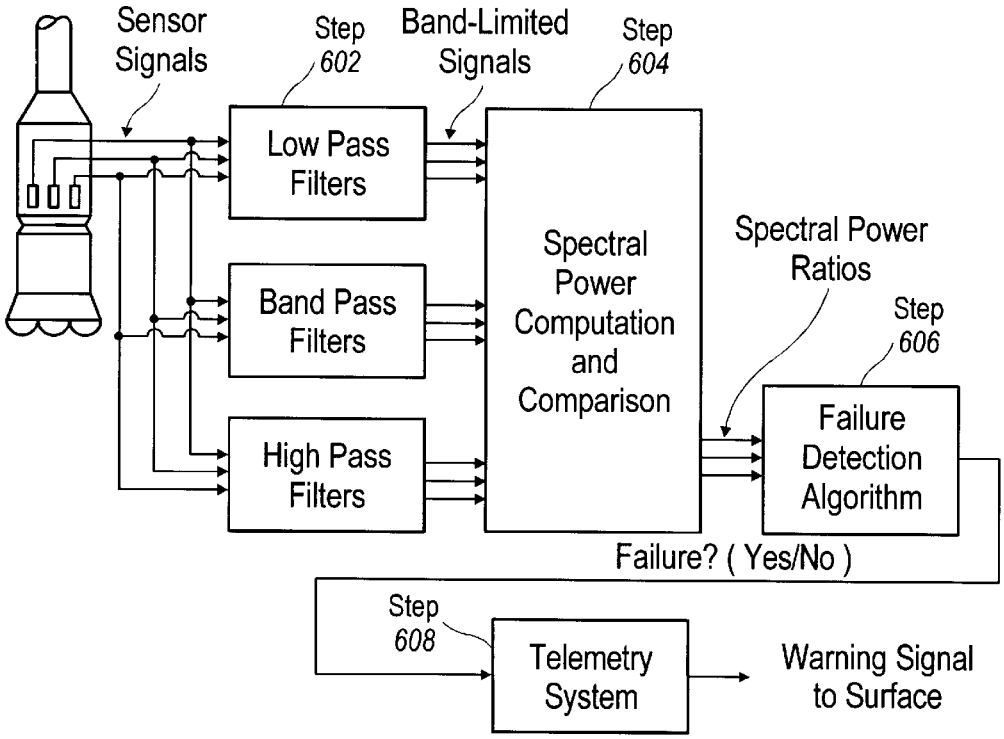
FIG. 6 shows a process flow for the spectral power ratio analysis method.

In the actual downhole tool implementation, it is preferable to perform "real-time" on-the-fly fast Fourier transforms (FFT). Approximately the same result can be obtained in another embodiment by using a set of analog filters to separate the frequency bands of the sensor signals. FIG. 6 shows a block schematic of this type of system.

Sensor signals from the sub assembly are directed to filters of varying pass bands (step 602), passing signals limited in frequency range by the filters. Three different pass bands are shown in this example, producing three band limited signals. These are passed to circuitry which performs spectral power computations and comparisons (step 604), producing spectral power ratios. These ratios are monitored for failure indicators with a failure detection algorithm (step 606). If a failure is detected, a failure indication signal is passed to the telemetry system (step 608) which sends a warning signal to the surface operator.

The example system shown in FIG. 6 can be implemented with minimal hardware requirements. The amount of digital signal processing required directly impacts the amount of downhole electrical power needed to power the electronics and the cost associated with the processing electronics. There is little interest in the phase relationship of the different frequency bands of the sensor signals so simple analog low-pass, band-pass and high-pass filters can be used to separate the signal components contained in each of the bands. Each of the filtered signals are then squared and summed over the window of time for which spectral power is to be compared. Ratios of these squared sums are then computed to form the R1, R2 and R3 spectral power ratios described above. These ratios are then used as previously described to detect a bearing failure. This type of analysis will be demonstrated on actual test data in the next section.

SPRA Method Experimental Verification

To verify the validity of the SPRA method, experimental data was collected from a laboratory test of an actual drill bit in operation. In this section the performance results of the SPRA method when applied to experimental data will be presented. Experimental data was collected while using an actual roller cone bit to drill into a cast iron target. Sensors were mounted to a sub directly above the bit and a data acquisition system was used to record the sensor readings. Accelerometers were attached to the sub directly above the bit. Both single axis and tri-axial accelerometers were used. The bit was held stationary in rotation and loaded vertically into the target while the target was turned on a rotary table.

The sampling rate for most of the data recorded was 5000 hertz. Test data was recorded at sample rates of 5000, 10,000, 20,000 and 50,000 hertz. A frequency analysis showed that a very high percentage of the total signal power was below 2000 hertz. For this reason and to reduce unnecessary data storage, a sample rate of 5000 hertz was used for most of the tests.

Figure 7:
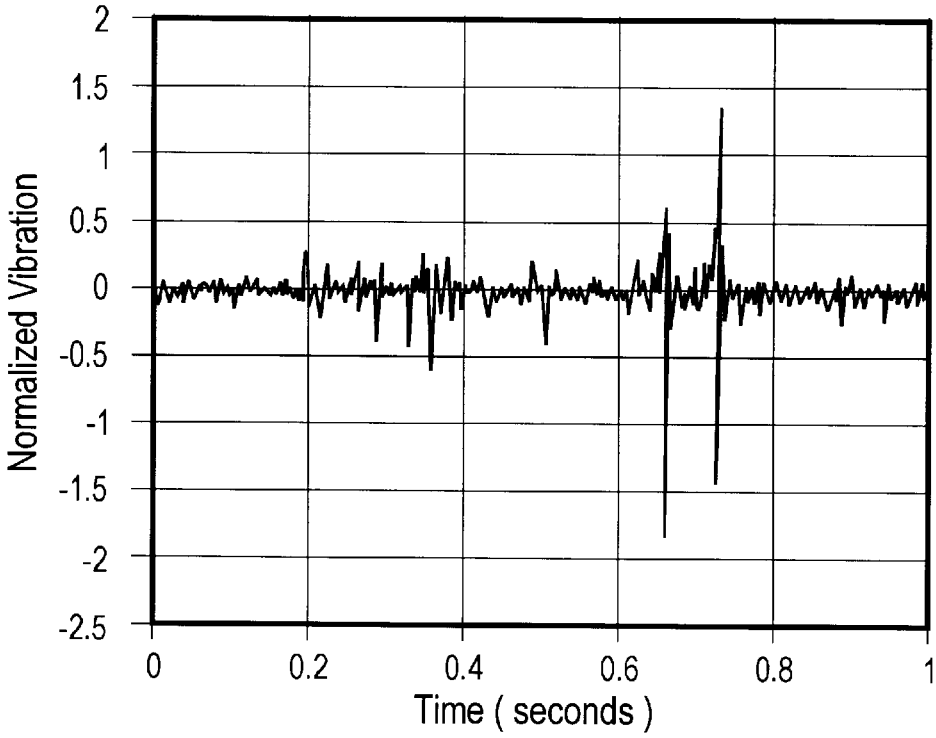
FIG. 7 shows a graph of normalized bit vibrations.
Figure 8:
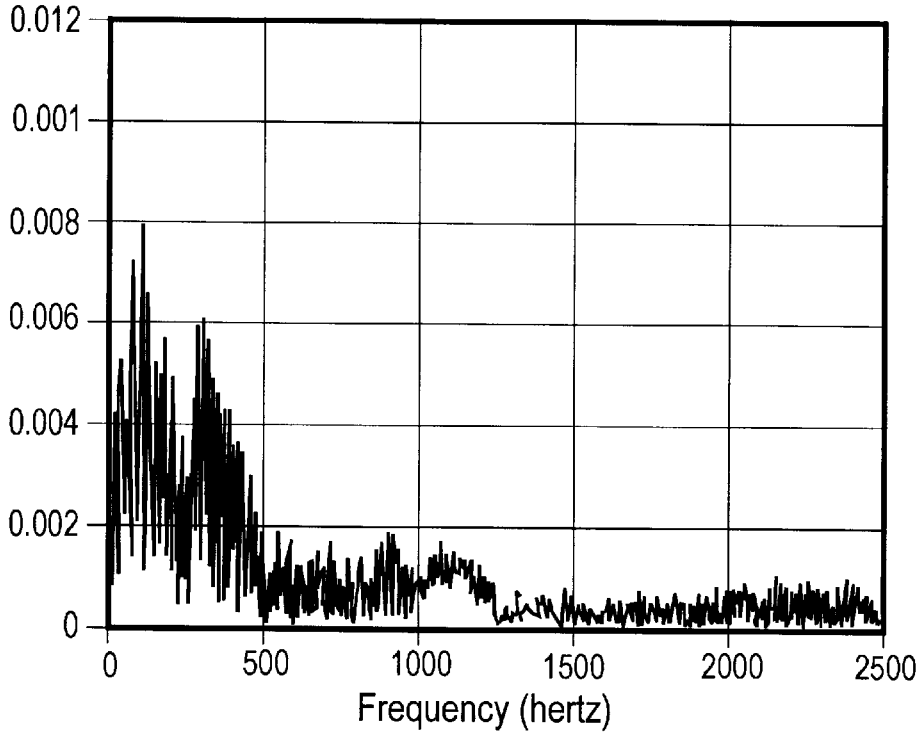
FIG. 8 shows a Fourier transform of the data from FIG. 7.

An IADC class 117W 12¼" XP-7 bit was used for all tests. The test procedure consisted of flushing the number 3 bearing with solvent to remove most of the grease and then running the test bit with a rotational speed of 60 rpm and a constant load of 38,000 pounds. Cooling fluid was pumped over the bit throughout the test. Under these drilling conditions the contamination level in the number three bearing was increased in steps. This process continued until the number 3 bearing was very hot, and was beginning to lock up. Baseline data with the bit in good condition and the bearing at a low temperature was taken before any contamination was introduced to the bit. A section of this data is shown in FIG. 7. FIG. 8 shows a Fourier transform of the data shown in FIG. 7.

Figure 9:
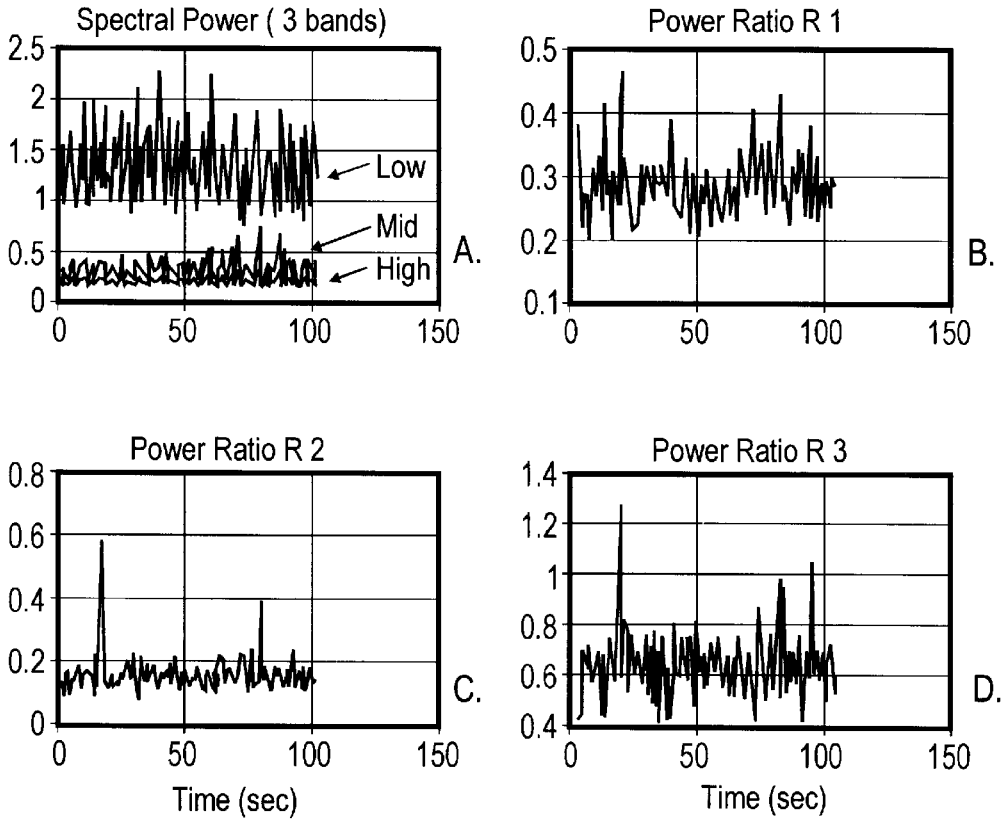
FIG. 9 shows spectral power analysis for sample bearings.

Notice in FIG. 8 that most of the spectral power is located from 0–500 hertz. This is typical for normal drilling operations. The. SPRA method was applied to this data. The 2500-hertz frequency spectrum was broken into three bands. The frequency range for each of the bands was 10–500 Hz, 750–1500 Hz and 1600–2400 Hz. A normalized spectral power was computed for a one-second window of data centered on each sample in time. A time-series plot of the spectral power for each frequency band is shown in FIG. 9*a*. It is apparent from this plot that the majority of the spectral power is located in the lower frequency range. The normalized low range average power level is about 1.5. The mid and high range average power levels stay below about 0.5. FIG. 9*b* shows a plot of the spectral power ratio R1 that was previously defined as the ratio of the midrange (750–1500 Hz) spectral power to the low range (10–500 Hz) spectral power. We can see here that as expected, the ratio is fairly low. The same is true for the ratio R2 that is the ratio of high range (1600–2300Hz) to the low range power (10–500 Hz). If the level of high frequency power increases (i.e. during a bearing failure) the ratios R1 and R2 should increase.

Figure 10:
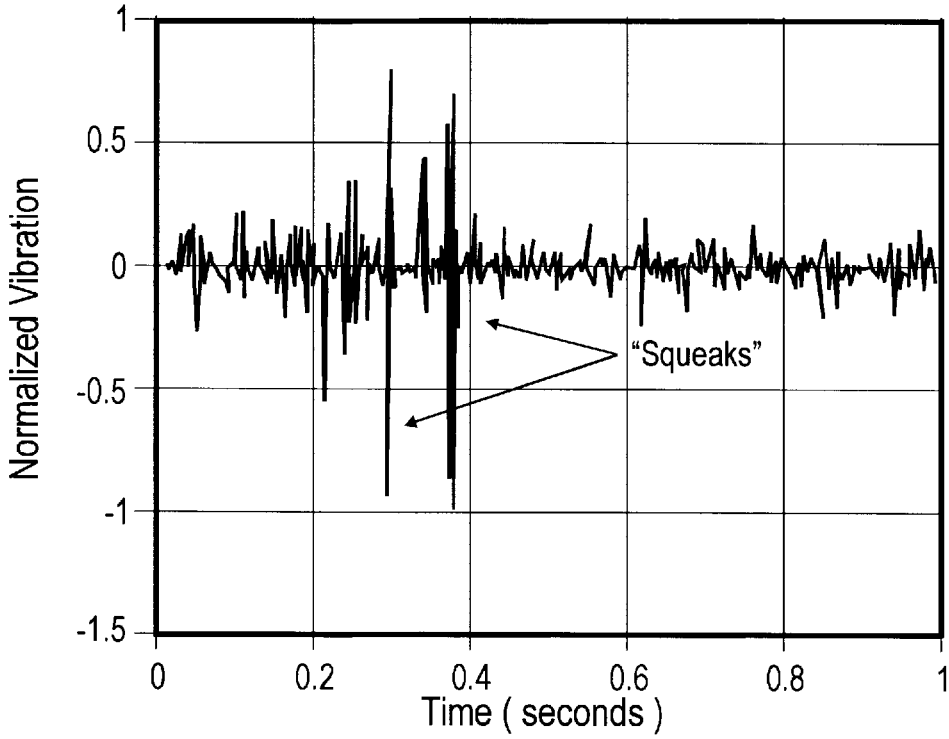
FIG. 10 shows normalized bit vibrations with slight bearing damage.

Testing continued for several hours. Twice during the test a drilling mud consisting of 1.4 liters of water, 100 grams of bentonite and 1.1 grams of sodium hydroxide was pumped into the number 3 bearing area. After the addition of the mud and after extended drilling some bearing failure indications were indicated by "squeaks" in the accelerometer data shown in FIG. 10.

Figure 11:
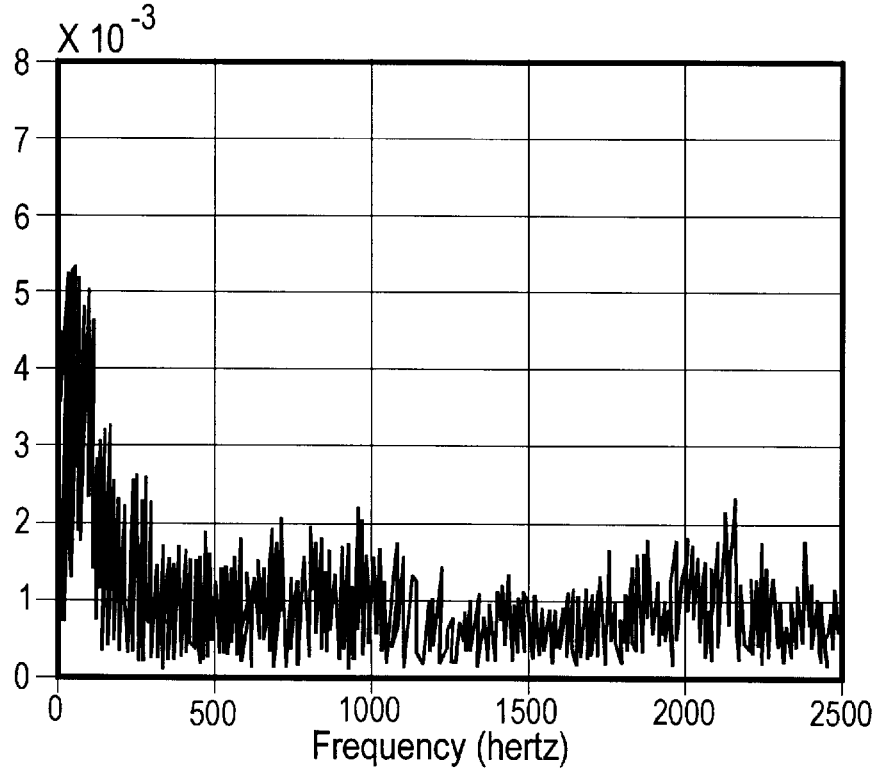
FIG. 11 shows a fast Fourier transform of vibration data with initial bearing damage.

These "squeaks" in the bearing can be detected quantitatively by examining the discrete Fourier transform of this data as shown in FIG. 11.

Figure 12:
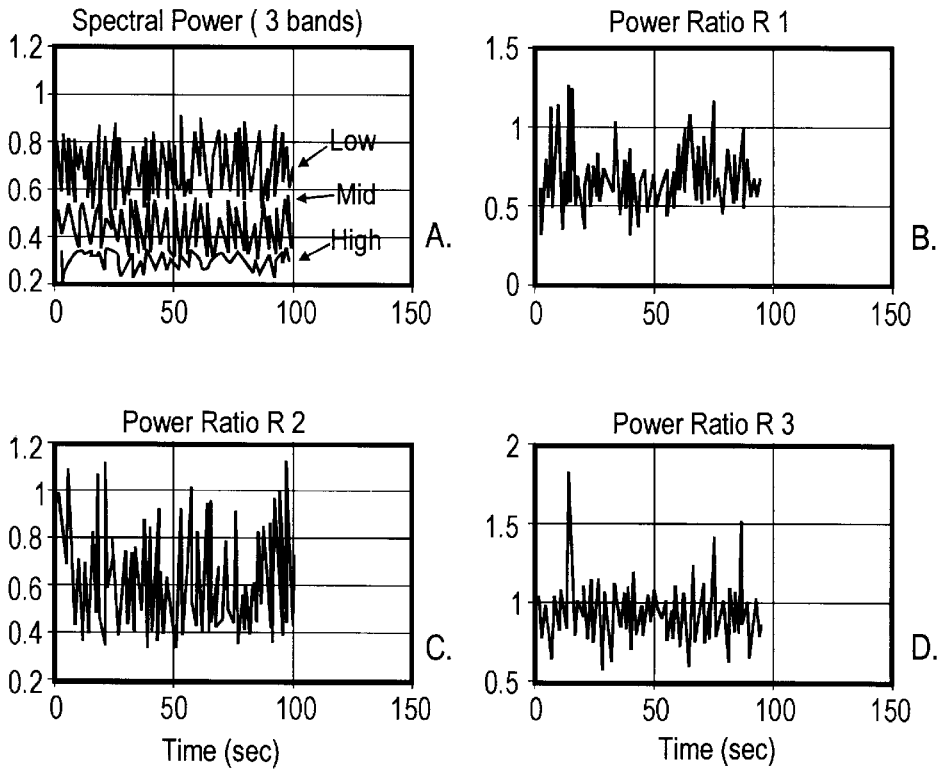
FIG. 12 shows spectral power analysis for sample damaged bearings.

The high frequency contributed by the bearing noise can clearly be seen as increased high frequency content in the spectral plot. Applying the SPRA method we obtain the series of plots shown in FIG. 12. In FIG. 12*a* it is obvious that the energy in the mid and high frequency bands has increased relative to the low frequency power. This is directly related to the bearing noise. We can also see that the power ratios R1 and R2 have increased from an approximate average of 0.3 and 0.2 to 0.75 and 0.65 respectively. We can also see qualitatively that the standard deviation of the power ratios has increased as well.

Figure 13:
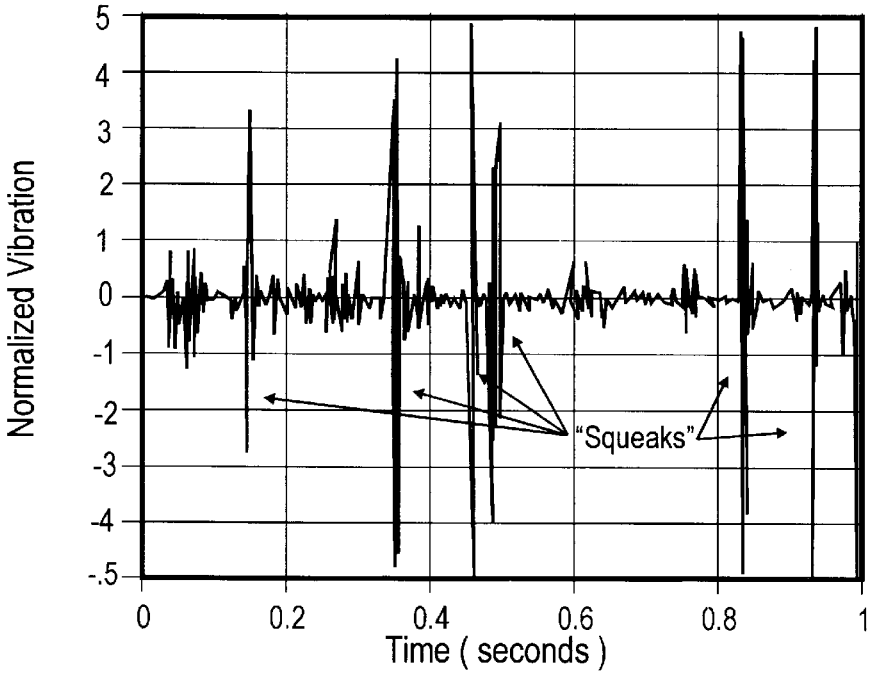
FIG. 13 shows normalized bit vibrations with moderate bearing damage.
Figure 14:
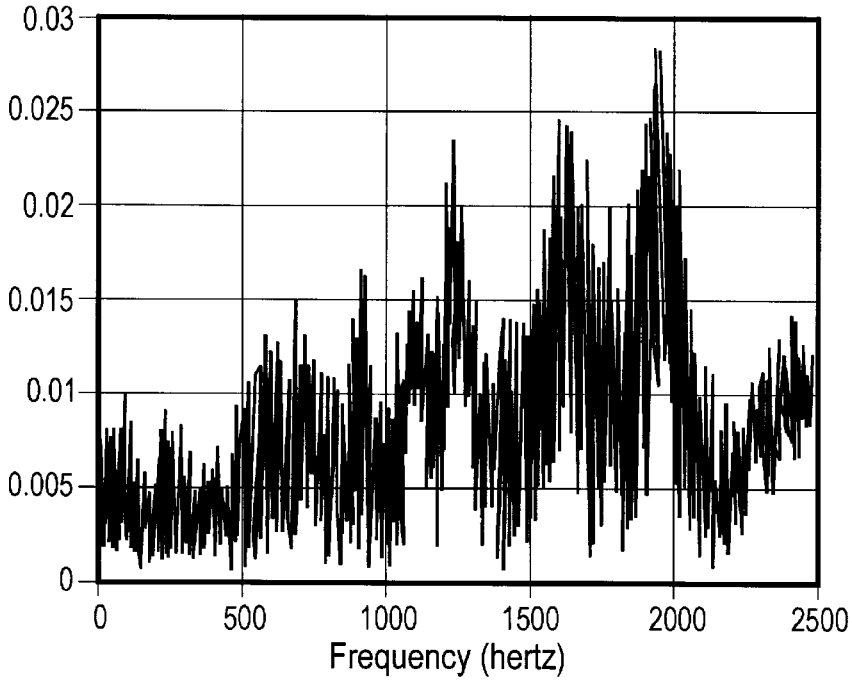
FIG. 14 shows a fast Fourier transform of vibration data with moderate bearing damage.

After a fairly long period of drilling the test was halted and a solution of 1.4 liters of water, 100 grams of bentonite, 1.1 grams of sodium hydroxide, and about a gram of sand was pumped into the number 3 bearing area. Drilling resumed, and the bearing quickly began to show signs of increasing failure. The squeaking frequency increased and became audible. FIG. 13 shows a plot of the accelerometer data. FIG. 14 shows the discrete Fourier transform of the data.

Figure 15:
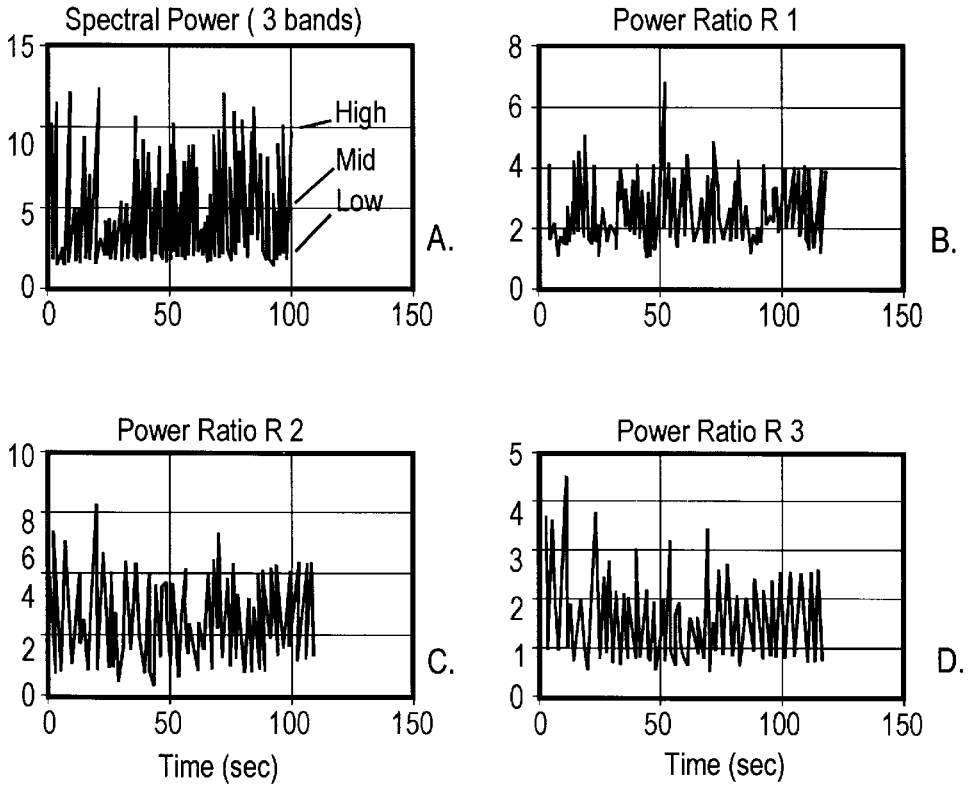
FIG. 15 shows spectral power analysis for moderately damaged bearings.

Applying the SPRA method we obtain the series of plots shown in FIG. 15. Notice in FIG. 15*a* that the power contained in the mid and high frequency bands now exceeds the power contained in the low frequency band. Looking at the power ratio plots we see that the R1 and R2 ratios are now very high (3.5 and 4) compared to these ratios in the undamaged bearing (0.3 and 0.2). This is a clear indication of a bearing failure in progress. Additionally, the standard deviation of the power ratios has increased dramatically.

Mean Strain Ratio Analysis

Figure 16:
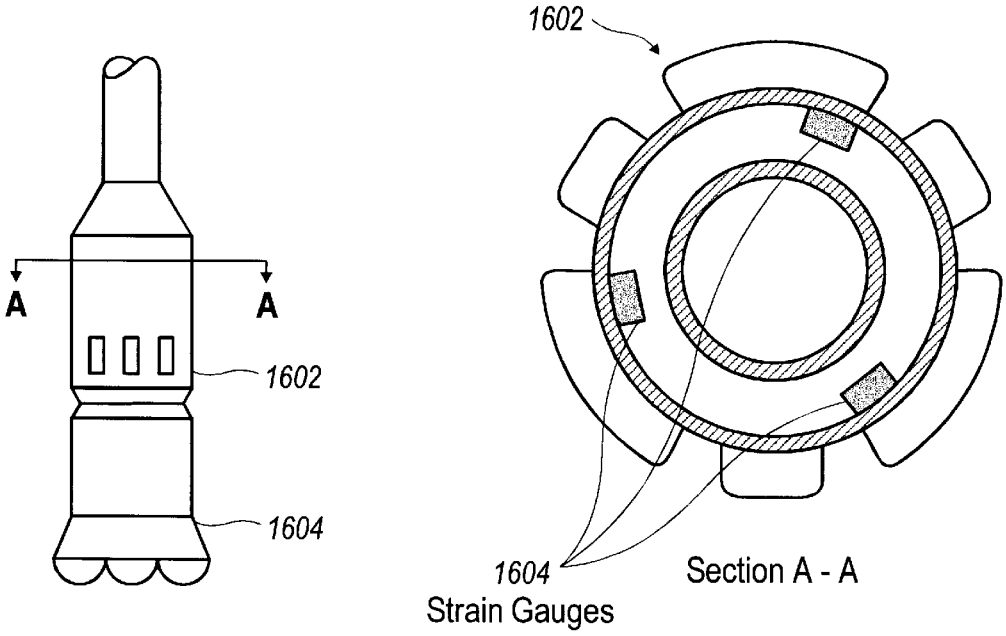
FIG. 16 shows a drill string and sensor placement on an instrumented sub.

This class of example embodiments demonstrating innovations of the present application are herein referred to as the Mean Strain Ratio Analysis (MSRA) method. Though the innovations are described using the particular examples given, it should be understood that these examples do not limit the implementation of the innovative ideas of this application. In an exemplary embodiment of this method strain measurements taken from an instrumented sub directly above the bit are used to detect changes in induced bending and axial stresses which are related to a roller cone bearing failure. In one embodiment, the strain gauges are located 120° apart around the instrumented sub (though this is not required, and asymmetric arrangements work as well, as discussed below). FIG. 16 shows the placement of the strain gauges in a sample embodiment.

FIG. 16 shows a drill string with a sub assembly 1602 and drill bit 1604. The cross sectional view (along A_A) shows the placement of strain gauges 1606, here shown as symmetrically distributed around the sub 1602. Of course, the strain gauges 1606 need not be symmetrically placed, since failures are detected by relative changes in the readings.

There is an average percentage of the total load on the bit that each of the cones on a roller cone bit will support. The axial strain detected at one of the strain gauge locations shown in FIG. 16 will depend on three main factors. These are the location of the strain gauge relative to the cones on the bit in the made up BHA, the weight on the bit, and the bending load produced by eccentric loading on the cones. Other factors can also produce axial strain components but less significantly than those noted above. The strain gauges are not set up to measure torsion-induced shear strains. As one cone in the bit begins to fail, the average share of the total load on the bit that the failing cone can support will change. This change will cause a change in the bending strain induced by the eccentric loading on the cones. When a bit is new (i.e. no bearing failure), the average amount of strain measured by each strain gauge in FIG. 16 will maintain a fairly constant percentage of the average strain in each of the other strain gauges. In other words, if an average value of strain for each of the strain gauges is computed, then divided by a similar average strain value for each of the other strain gauges, this ratio will remain fairly constant, even if the load on the bit is varied. However, when the percentage of the load changes as an individual cone wears faster than the other cones or suffers dramatic bearing wear, the ratio of the average strain at each of the strain gauge locations will change. These ratios can be defined as:

$$SR1=(\text{Average Strain in Gauge } 2)/(\text{Average Strain in Gauge } 1)$$

$$SR2=(\text{Average Strain in Gauge } 3)/(\text{Average Strain in Gauge } 1)$$

$$SR3=(\text{Average Strain in Gauge } 3)/(\text{Average Strain in Gauge } 2)$$

Figure 17:
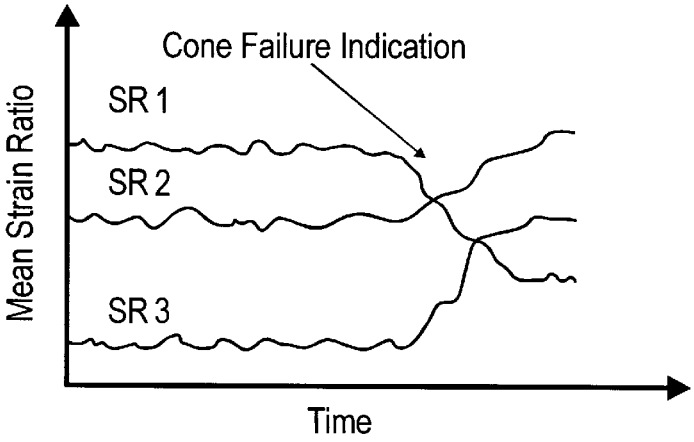
FIG. 17 shows the mean strain ratio method failure indication, plotted as normalized strain against time.

The strain at any one strain gauge is approximately linearly dependent on the weight on the bit for moderate loads, so a relative strain induced at any one of the strain gauges as compared to any other of the strain gauges is independent of the weight on the bit. On the other hand, this ratio is highly dependent on the percentage of the load supported by each of the cones. If one cone tends to support more or less of the total load on the bit (as we would expect during a cone failure), this change in loading will translate to a change in relative average strain at the strain gauge locations. It is this change that is monitored in the MSRA method to detect bit failure. FIG. 17 illustrates the detection method in a qualitative way. Quantitative results will be presented in a later section. As FIG. 17 shows, the strain measured by the gauges changes relative to the others at a certain point indicated by the arrow. This change in relative measurements indicates failure.

Figure 18:
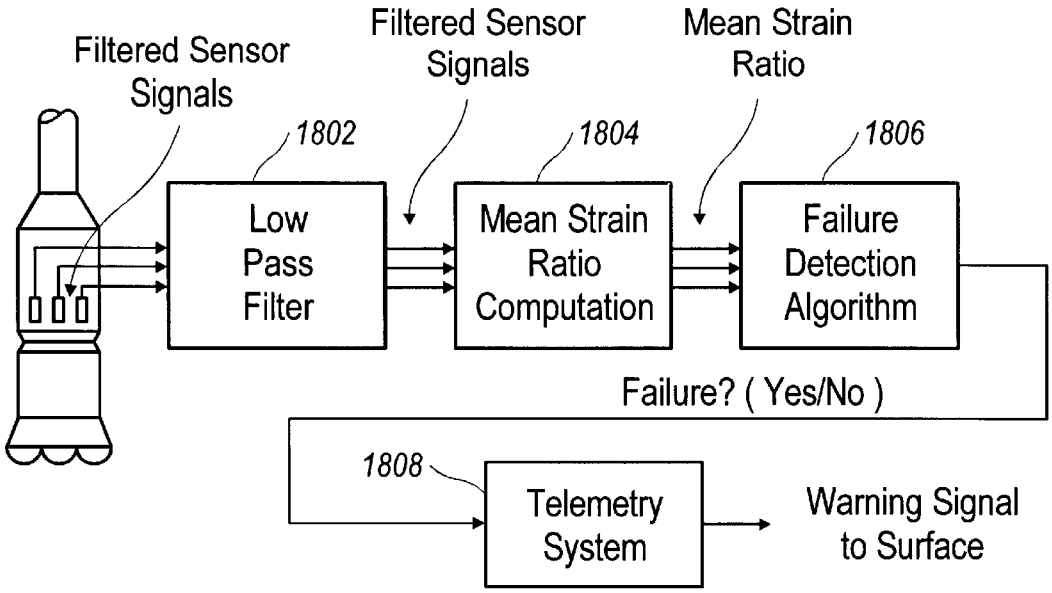
FIG. 18 shows a process flow for the mean strain ratio failure detection scheme.

A flow showing an example of the MSRA detection scheme is shown in FIG. 18. In this embodiment, the strain gauges send data to a low pass filter which filters the sensor signals (step 1802) and passes the result to circuitry which computes the mean strain ratios (step 1804). These are used by the failure detection algorithm to detect a bit failure (step 1806). If a failure is detected, the telemetry system sends a warning signal to the surface (step 1808).

One disadvantage of the MSRA detection scheme is that it will work best after significant bearing wear has occurred. A major advantage of the MSRA method is the low required digital sampling rate, which translates to low computational and electrical power requirements. This makes the system less expensive and smaller.

MSRA Method Experimental Verification

To verify the validity of the MSRA method, experimental data was collected from a laboratory test of an actual drill bit in operation. In this section the performance results of the MSRA method when applied to experimental data will be presented. Experimental data was collected while using an actual roller cone bit to drill into a cast iron target. Sensors were mounted to a sub directly above the bit and a data acquisition system was used to record the sensor readings. Strain gauges were attached to the sub with 120° phasing directly above the bit. The bit was held stationary in rotation and loaded vertically into the target while the target was turned on a rotary table.

The sampling rate for most of the data recorded was 5000 hertz. Test data was recorded at sample rates of 5000, 10,000, 20,000 and 50,000 hertz. A frequency analysis showed that a very high percentage of the total strain gauge signal power was below 250 hertz. For this reason and to demonstrate the effectiveness of the method with very low sampling rates, most of the data analysis was performed on 5000 Hz data, which was down-sampled to 500 Hz.

Figure 19:
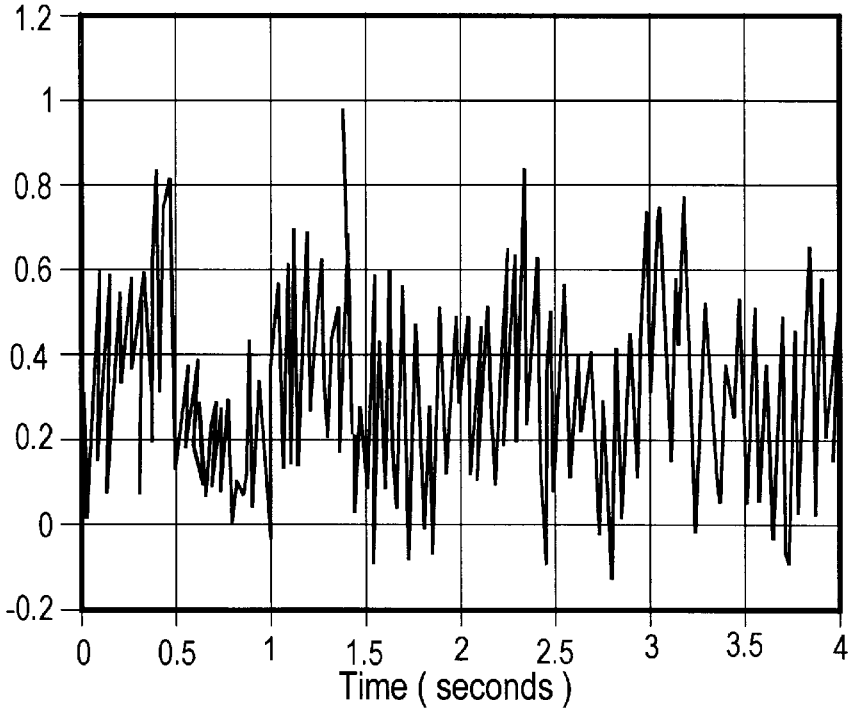
FIG. 19 shows a section of a baseline strain gauge signal.
Figure 20:
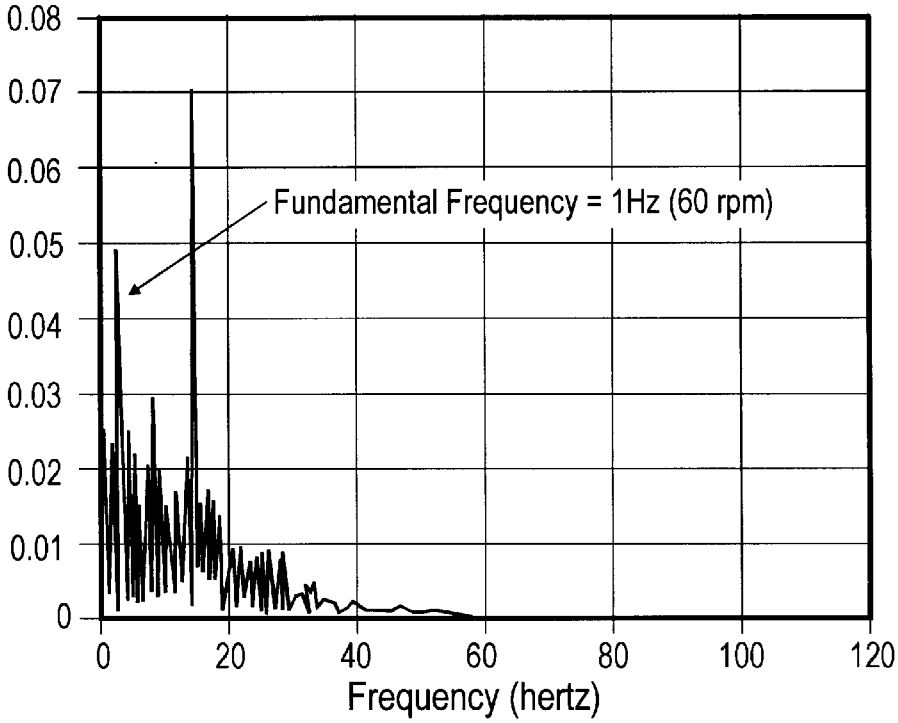
FIG. 20 shows a plot of the frequency spectrum of the data from FIG. 19.
Figure 21:
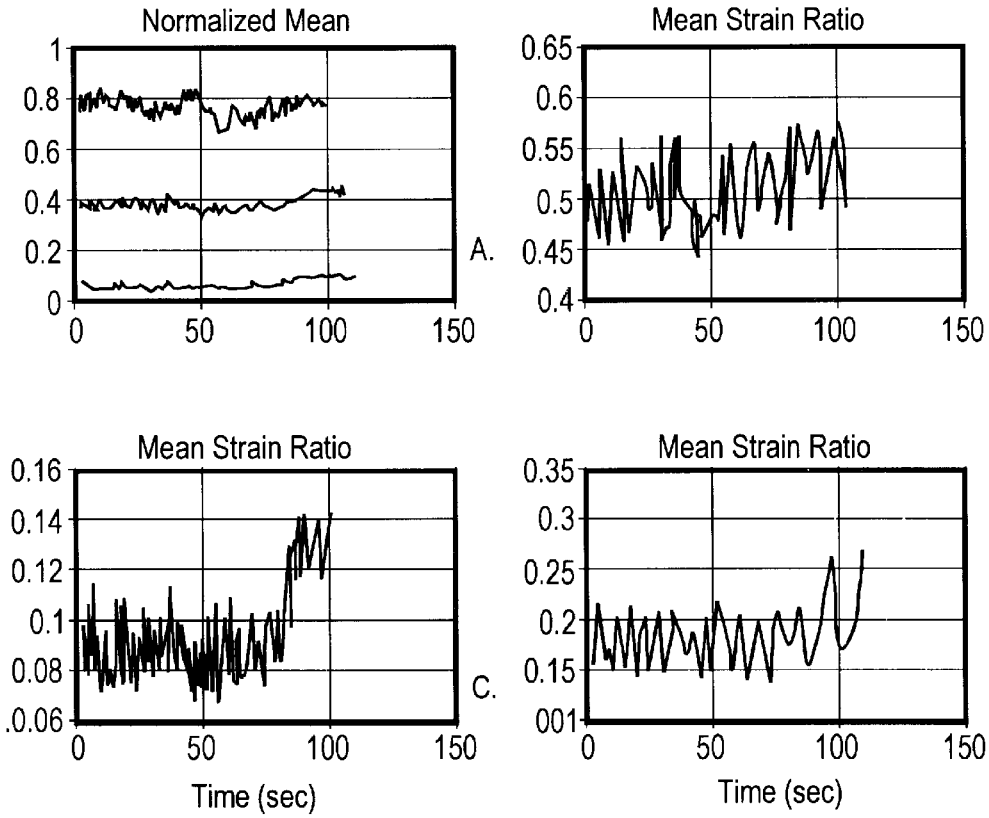
FIG. 21 shows a time series plot of the mean strain ratio for each of the strain gauges.

An IADC class 117W 12¼" XP-7 bit was used for all tests. The test procedure consisted of flushing the number 3 bearing with solvent to remove most of the grease and then running the test bit with a rotational speed of 60 rpm and a constant load of 38,000 pounds. Cooling fluid was pumped over the bit throughout the test. Under these drilling conditions the contamination level in the number three bearing was increased in steps. This process continued until the number 3 bearing was very hot, and was beginning to lock up. Baseline data with the bit in good condition and the bearing at a low temperature was taken before any contamination was introduced to the bit. FIG. 19 shows a section of the baseline #1 strain gauge signal. The vertical axis is not scaled to any actual strain level, as the absolute magnitude is not critical for the MSRA method. This plot reveals the periodic nature of the strain in the BHA. FIG. 20 shows a plot of the frequency spectrum of the window of data shown in FIG. 19. Notice the concentration of spectral energy below 40 Hz and the "spike" at 1 Hz, which corresponds, with the rotational speed of the bit at 60 rpm. FIG. 21*a* shows a time series plot of the normalized mean strain for each of the strain gauges. These plots represent the average strain for each gauge location over time. The mean values are fairly constant. FIG. 21*b*, FIG. 21*c* and FIG. 21*d* show time series plots of the strain ratios SR1, SR2 and SR3 respectively. We can see that these ratios do not change dramatically over the 100-second window data represented by the data in the plots.

This apparent lack of change in the strain ratios over a small 100-second window is not surprising. Significant changes in the bearings and hence their effect on the average strain ratio levels between the strain gauges can not be expected to occur over such a short period of time. In fact, large changes in the strain ratios can be expected to occur only over 1000s of seconds of drilling.

Figure 22:
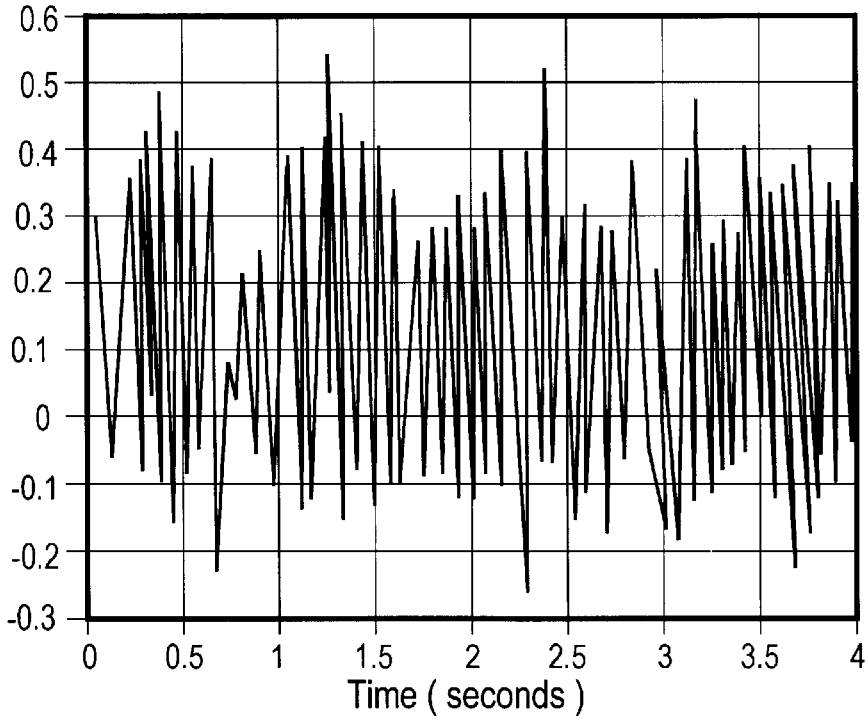
FIG. 22 shows a plot of normalized strain data from one gauge.
Figure 23:
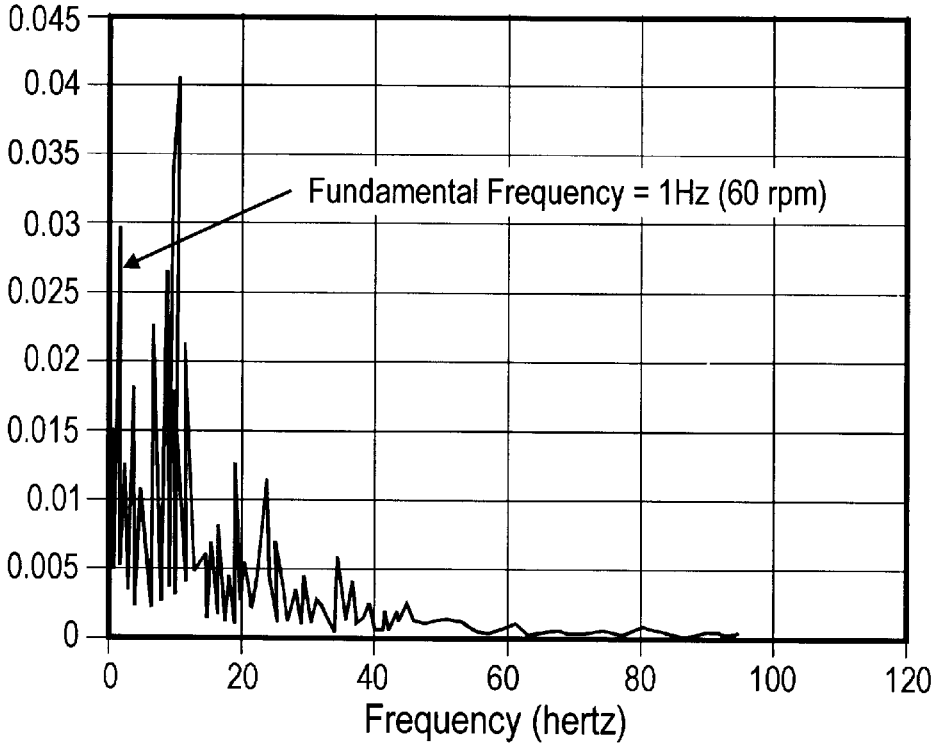
FIG. 23 shows a fast Fourier transform of the strain gauge data from FIG. 22.
Figure 24:
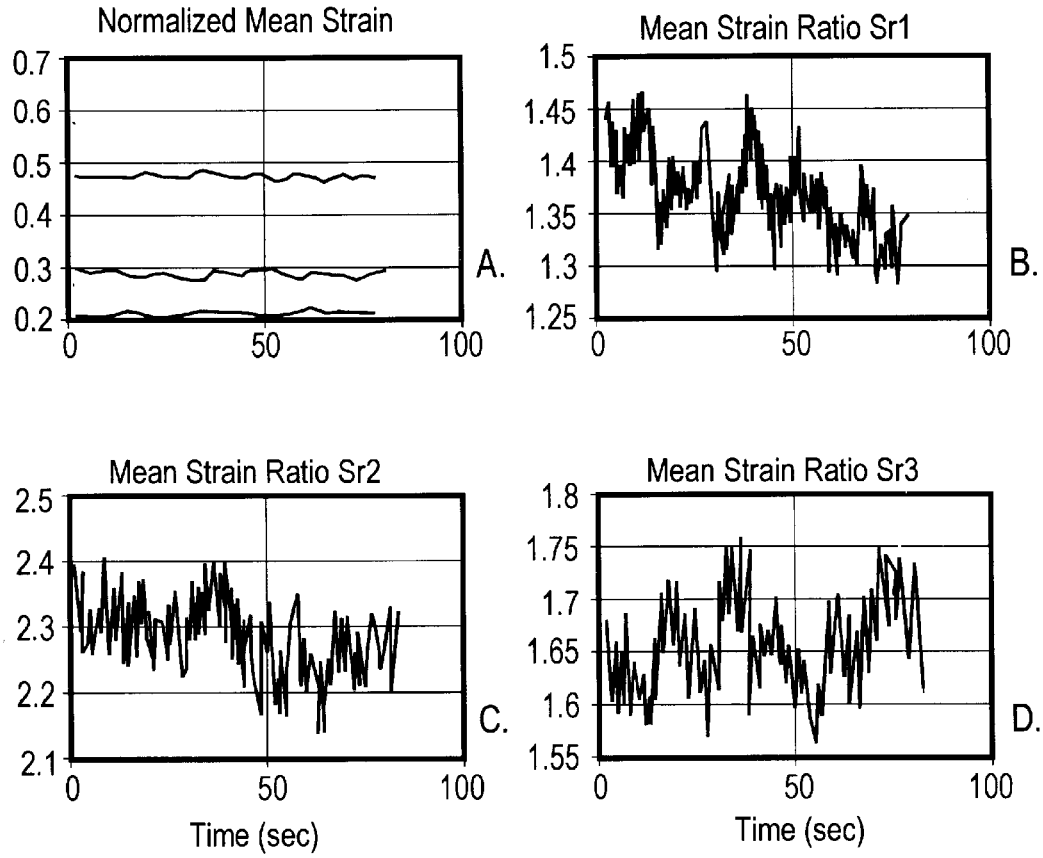
FIG. 24 shows mean strain analysis for a bearing with light damage.

In the next phase of the test drilling mud consisting of 1.4 liters of water, 100 grams of bentonite and 1.1 grams of sodium hydroxide was pumped into the number 3 bearing area at two different times during a 40 minute drilling session. Strain data was collected throughout the test. FIG. 22 and FIG. 23 show plots of the normalized strain indicated by one of the strain gauges and the Fourier transform of the same data. Again, the periodicity of the strain signal and the sharp peaks in the FFT representing the fundamental and some harmonic frequencies are apparent. We can also see a shift in the mean strain level, which appears as a DC offset in FIG. 22. FIG. 24*a* shows the mean strain values as a function of time. Comparing FIG. 24*a* to FIG. 21*a* we can see a shift in the average strain levels. This change occurred over the 40 minutes of drilling with mud present in the number 3 bearing. We can also see a change in the mean strain ratios of FIGS. 24*b, c*, and *d* as compared to FIGS. 21*b, C*, and *d*. This indicates a change in the average loading conditions in the instrumented sub. We can also see more erratic changes in the strain ratios.

Figure 25:
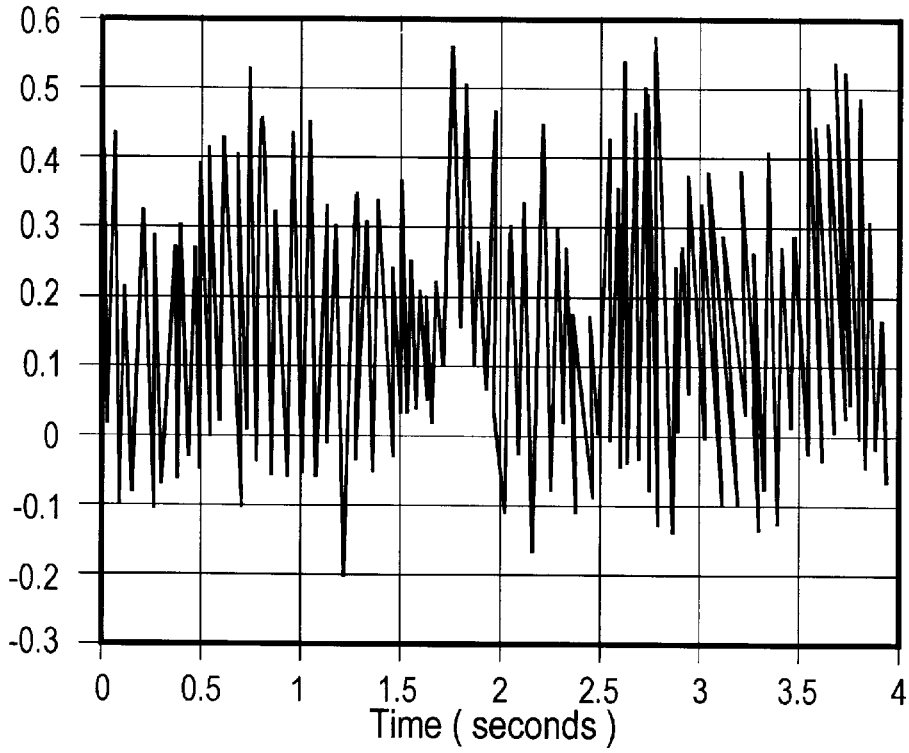
FIG. 25 shows a strain gauge signal for a bearing with moderate damage.
Figure 26:
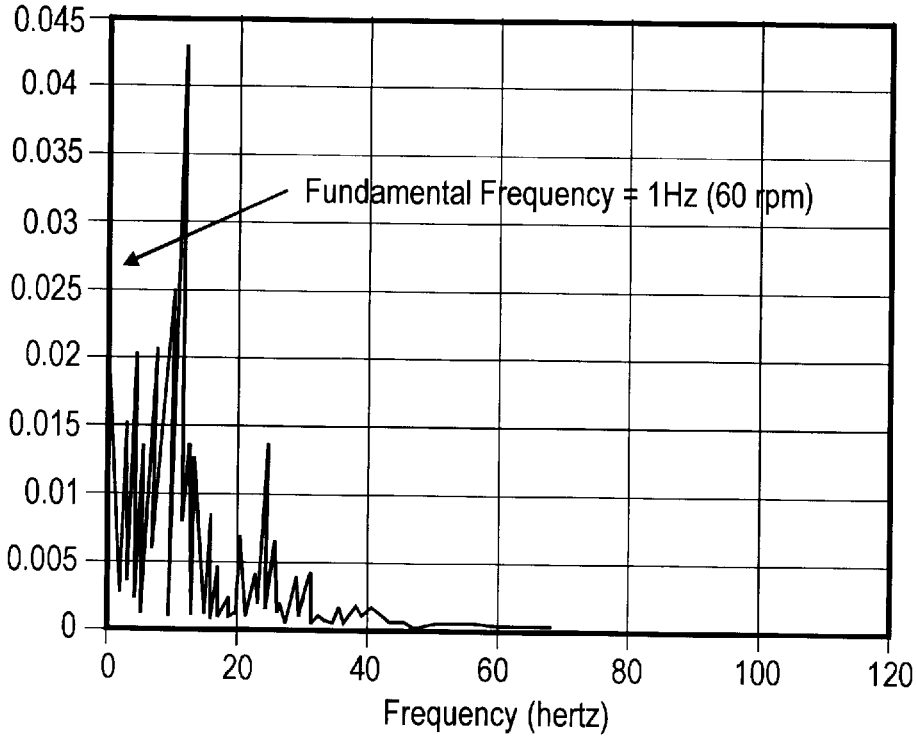
FIG. 26 shows a fast Fourier transform of the strain data from FIG. 25.
Figure 27:
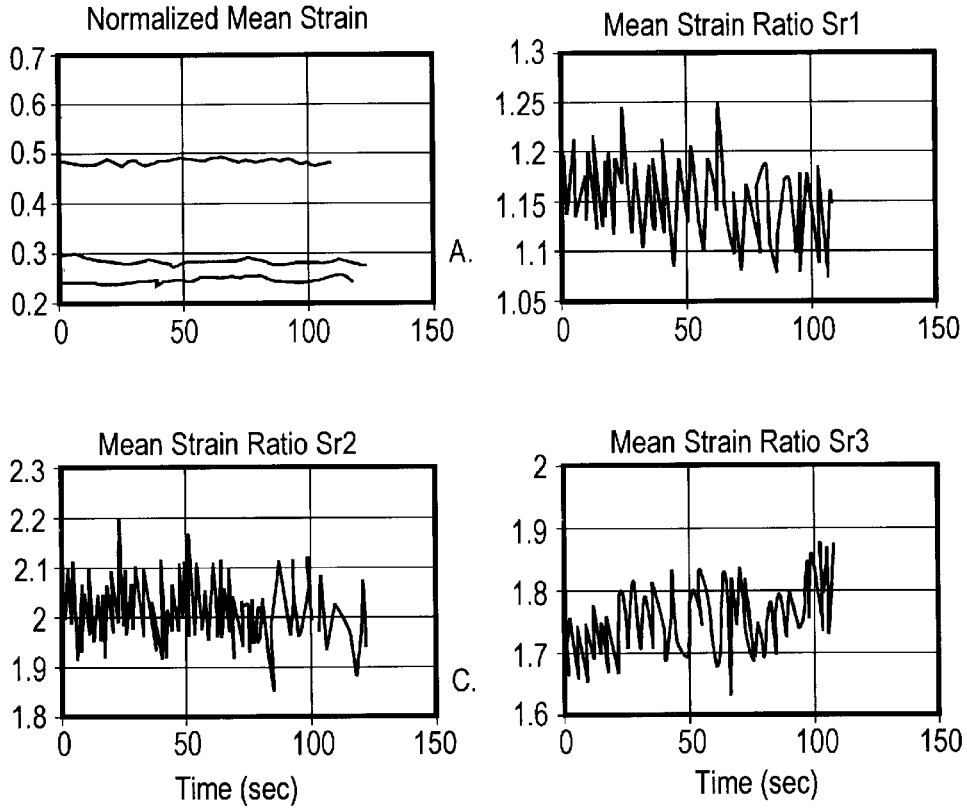
FIG. 27 shows a mean strain analysis for a bearing with moderate damage.

Testing continued for another 30 to 40 minutes. FIGS. 25, 26, and 27 show more test data. FIG. 27 shows more change in the mean strain ratios. The mean strain ratio plots continue to show an increase in erratic fluctuations of the signal.

Figure 28:
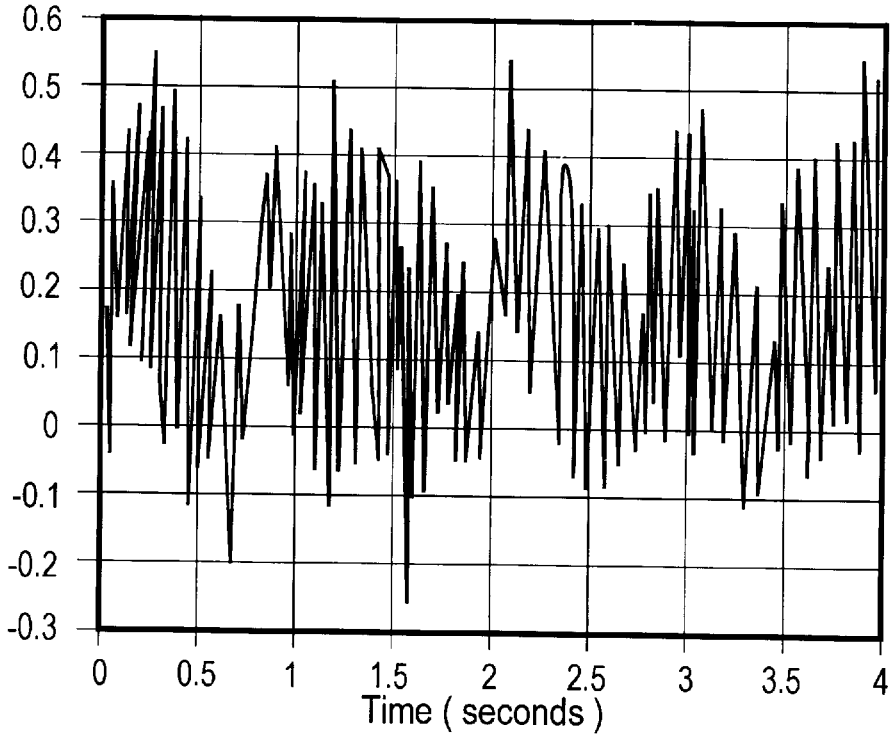
FIG. 28 shows analysis of data recorded under set drilling conditions.
Figure 29:
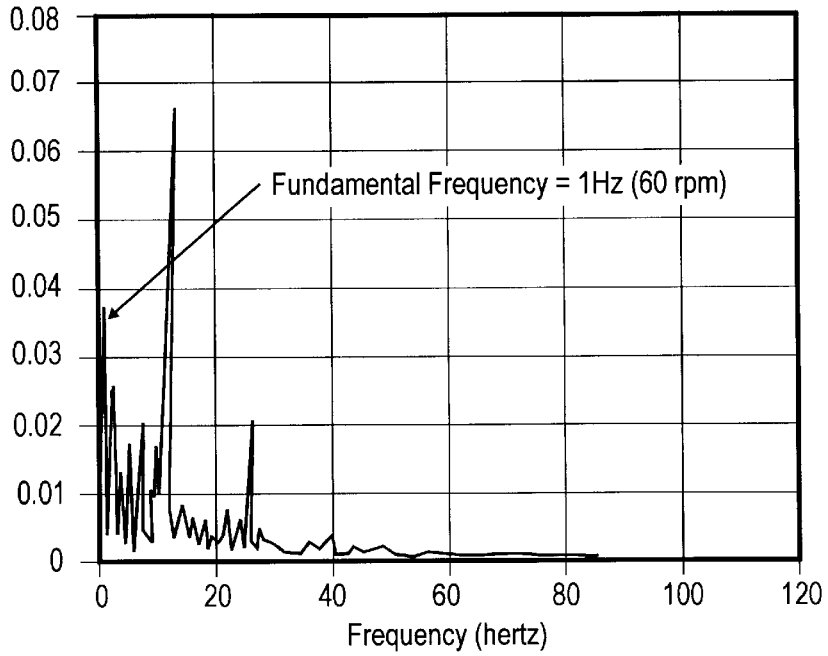
FIG. 29 shows a strain gauge signal for a bit in the early stages of failure.
Figure 30:
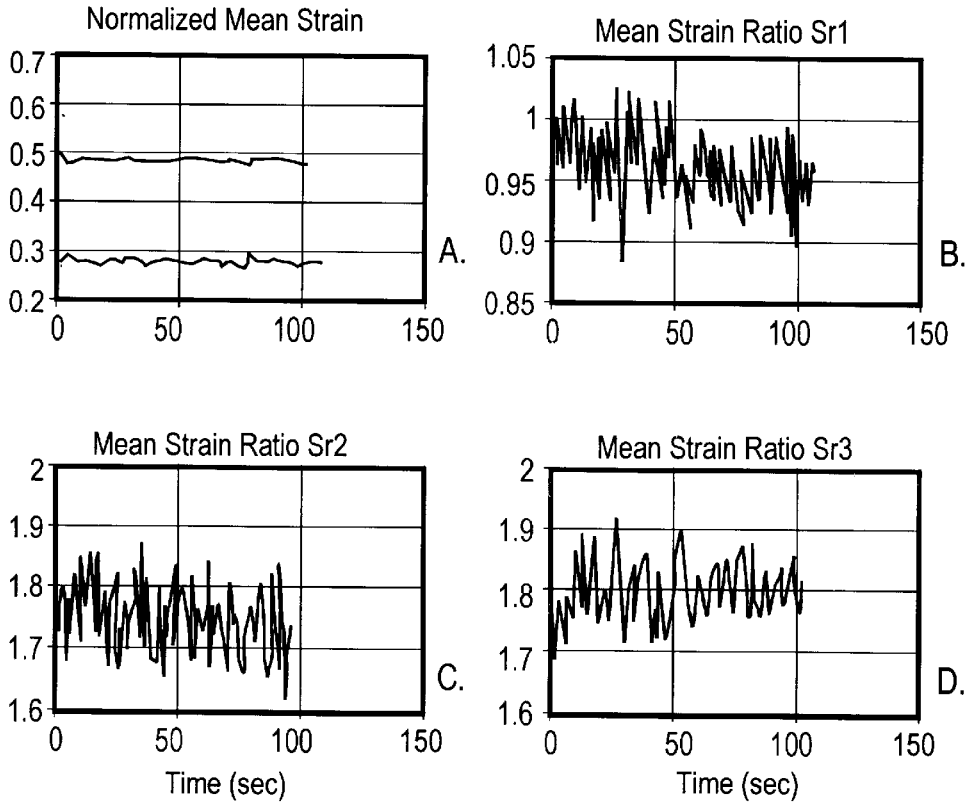
FIG. 30 shows mean strain analysis for a bearing in early failure.

In the last phase of the test drilling was halted and a solution of 1.4 liters of water, 100 grams of bentonite, 1.1 grams of sodium hydroxide, and about a gram of sand was pumped into the number 3 bearing area. Drilling resumed, and the bearing quickly began to show signs of increasing failure. The number 3 bearing began to produce steam as it heated up. FIGS. 28, 29, and 30 represent the analysis of data recorded under these conditions. Notice that the mean strain levels for each of the strain gauges have shifted dramatically from the start of the test. Two of the mean strain plots now lie on top of each other. These large changes represent a different loading condition within the bit and instrumented sub. It is obvious that significant changes in the bit loading conditions will effect the mean strain ratios. For instance, if a roller cone bearing has failed to the point that the bearing has become "sloppy", there will be a marked change in the portion of the vertical load supported by the individual cones. This change will be reflected in the strain gauge measurements taken within the instrumented sub.

Figure 31:
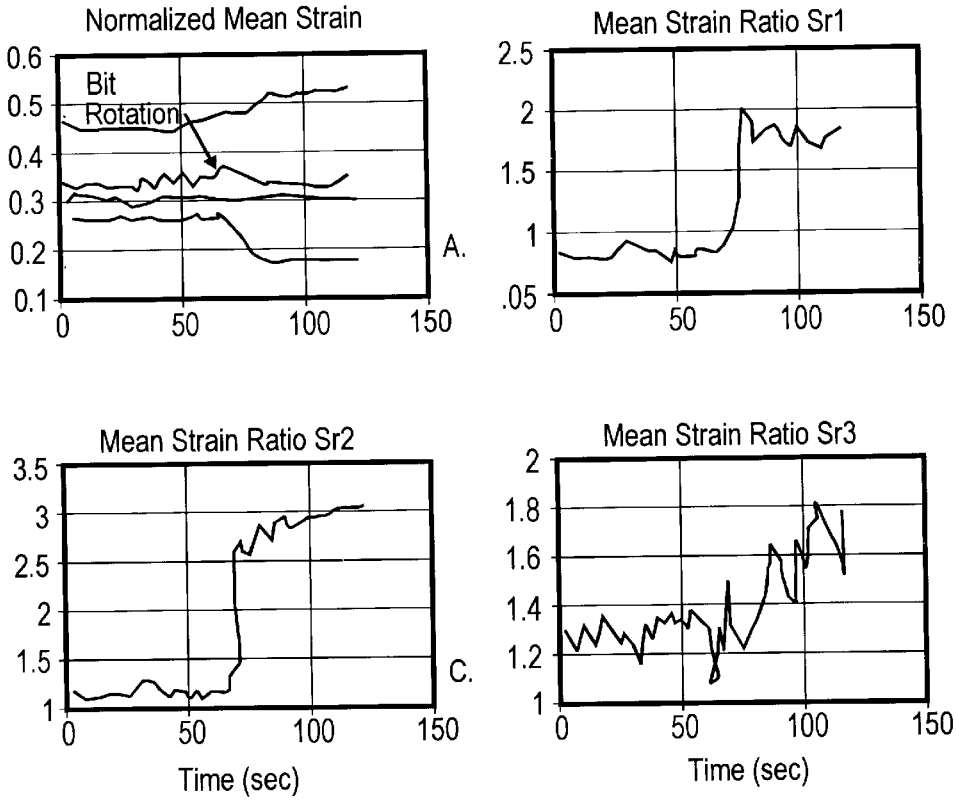
FIG. 31 shows a mean strain analysis for a shifting load condition.

FIG. 31 illustrates what happens when the loading conditions on the bit change. During this portion of the test the bit started out in a condition where the bit was not fully made-up to the sub. During the test, the bit rotated about 70 degrees and made-up to the sub. Because the relative location of the cones to the strain gauges in the sub changed, an abrupt change in the strain measured was recorded. Of course all the mean strain ratios changed as well, as FIG. 31 illustrates.

Adaptive Filter Prediction Analysis

In this application, reference is frequently made to neural networks and other adaptive filters. It should be noted that though neural nets are the most frequent example referred to herein, the use of this term is not meant to limit the embodiments to those which include neural nets. In most cases, any type of adaptive filter may be substituted for a true neural network. This method of detecting drill bit failure is referred to as the Adaptive Filter Prediction Analysis (AFPA) method. In this method an adaptive filter (preferably an adaptive neural network) is used to process sensor signals as part of an overall scheme to detect drill bit failure. This section contains a general description of an example implementation using a neural network or other adaptive filter.

Figure 32:
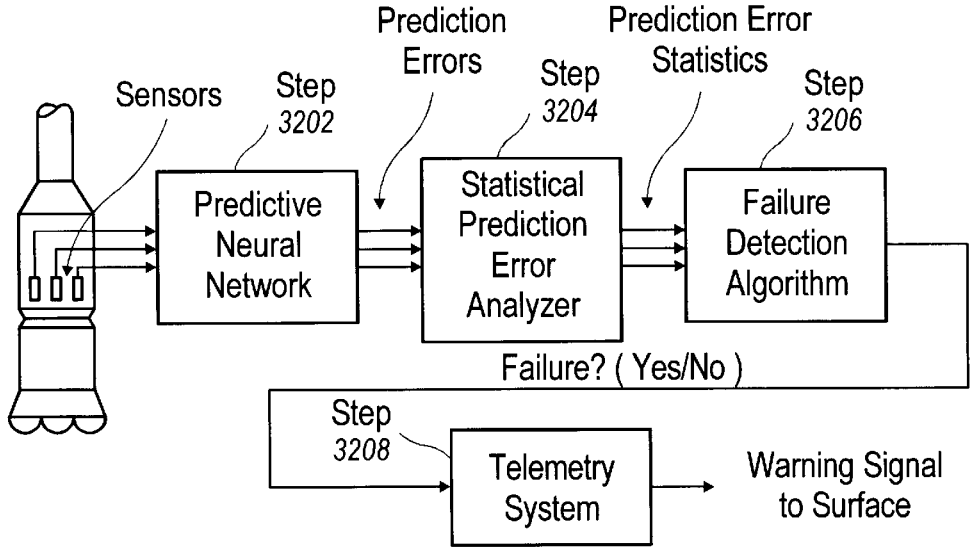
FIG. 32 shows an adaptive filter prediction method process flow.

FIG. 32 shows a schematic of an example embodiment failure detection system. Sensor signals from the instrumented sub are received by the adaptive filter, which uses past signal measurements to predict the next sensor value (step 3202). The adaptive filter (preferably a neural net) attempts to predict sensor readings one step ahead in time using older sensor readings (step 3204). The resulting prediction error statistics are analyzed by the failure detection algorithm for failure (step 3206), and if a failure is detected, the telemetry system sends a warning signal to the surface (step 3208).

Figure 33:
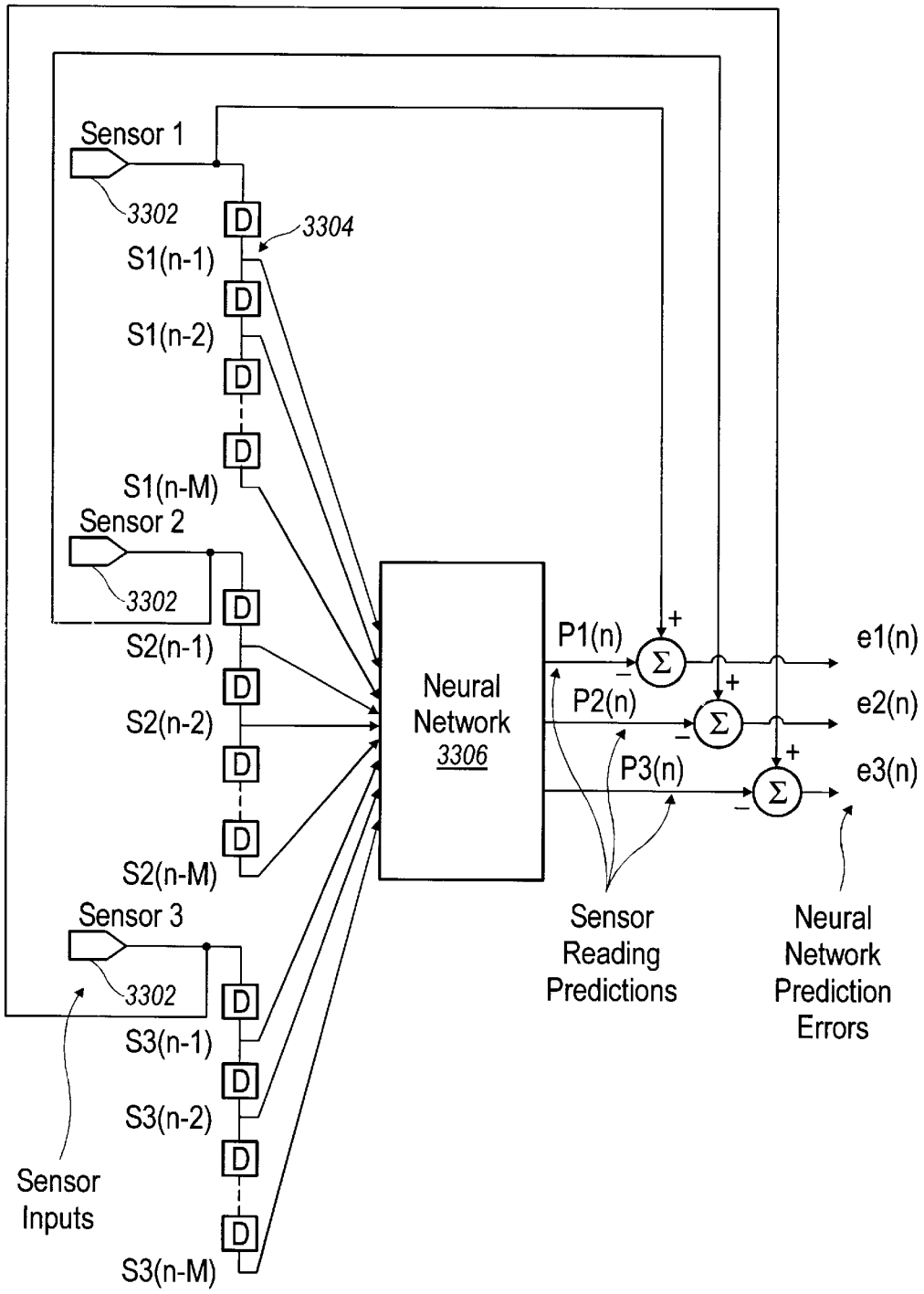
FIG. 33 shows a neural net schematic.

FIG. 33 shows a sample sensor data prediction scheme using a neural network (or other adaptive filter). The past sensor 3302 values are stored in a memory structure known as a tapped-delay-line 3304. These values are then used as inputs to the neural network 3306. The neural network 3306 then predicts the next value expected from each of the sensors 3302. The value (P1(n), P2(n), P3(n)) predicted for each of the sensors 3302 is then subtracted from the actual sensor readings to compute a prediction error (e1(n), e2(n), e3(n)). If the neural network prediction is good, the computed prediction error will be small.

If the prediction is poor, the prediction error will be high. Typically, the square of the prediction error is computed and analyzed to avoid negative numbers. If the signal being predicted is fairly repetitive (periodic) it is possible to successfully predict future signal values. If there is a large random component in the signal being predicted, or if the nature of the signal changes rapidly, it is very difficult to successfully predict future signal values. The innovative method exploits this characteristic to detect bit failures.

Figure 34:
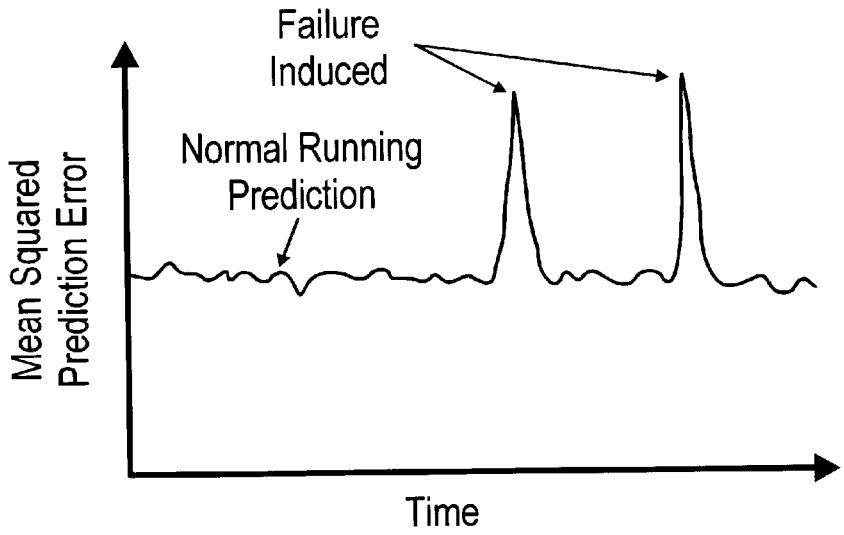
FIG. 34 shows failure indications in the adaptive filter prediction method.

Under normal drilling conditions with a bit in good condition, the vibration in the bit is fairly periodic with a significant random component added in. If an adaptive filter prediction is performed on a time-series of vibration measurements taken near the bit, there will be a level of prediction error, which does not change rapidly over a short period of time. This is because the filter will be capable of predicting much of the periodic vibration associated with the bit. However, random vibrations due to the drilling environment such as rock type, fluid noise, etc. will not be predictable and will result in prediction errors. Test data has shown that when a bearing in a cone starts to fail, it will generally emit bursts of high-frequency vibration or will cause the cone to lockup. Either of these occurrences will cause an abrupt and unpredictable change in the pattern of vibrations produced by the bit. If the prediction error of a adaptive filter that is being used to predict bit vibration is monitored, momentary increases ("spikes") in the prediction error will be observed. These observations can be used to detect roller cone bit failure. FIG. 34 illustrates the prediction error for normal running conditions and spikes in the prediction error related to failures.

One way to determine if a failure is in progress is to look for spikes in the prediction error which exceed a threshold value with an average frequency of occurrence that also exceeds a threshold frequency value. In other words if a high enough spike in the prediction error occurs often enough this means there is a failure in progress. Another way to detect failure is to monitor the standard deviation of the prediction error. If the standard deviation gets large enough, a failure is indicated. In addition to monitoring a threshold value for the prediction error it is useful to monitor the change in prediction error. As the following section will show, this method may be more effective at detecting bearing failure than looking at prediction error alone. These methods are examples of the many potential ways to analyze the filter prediction error to detect bit failure.

AFPA Method Experimental Verification

To verify the validity of the AFPA method, experimental data was collected from a laboratory test of an actual drill bit in operation. In this section the performance results of the AFPA method when applied to experimental data will be presented. Experimental data was collected while using an actual roller cone bit to drill into a cast iron target. Sensors were mounted to a sub directly above the bit and a data acquisition system was used to record the sensor readings. Accelerometers were attached to the sub directly above the bit. Both single axis and tri-axial accelerometers were used. The bit was held stationary in rotation and loaded vertically into the target while the target was turned on a rotary table.

The sampling rate for most of the data recorded was 5000 hertz. Test data was recorded at sample rates of 5000, 10,000, 20,000 and 50,000 hertz. A frequency analysis showed that a very high percentage of the total signal power was below 2000 hertz. For this reason and to reduce unnecessary data storage, a sample rate of 5000 hertz was used for most of the tests.

Figure 35:
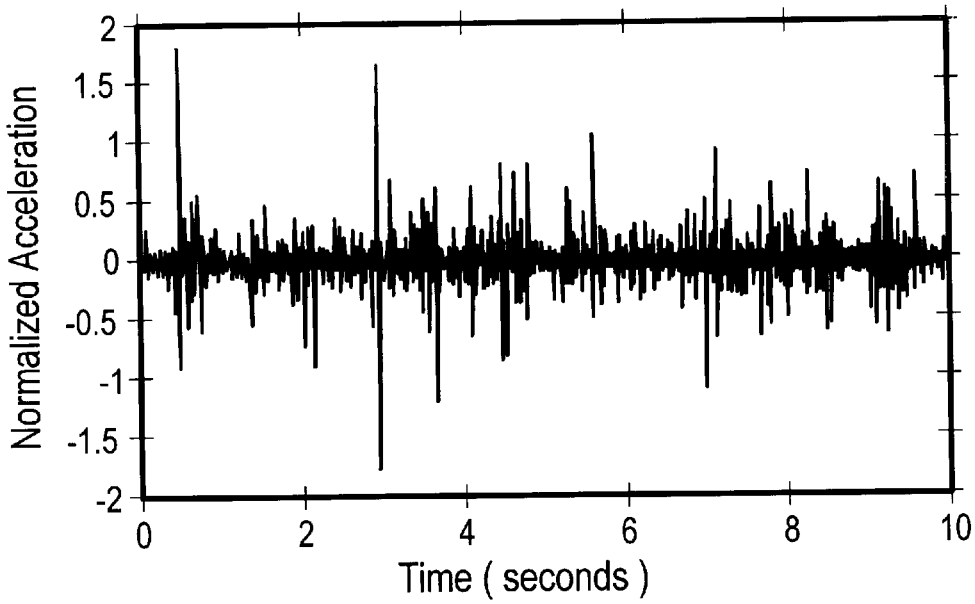
FIG. 35 shows acceleration sensor readings for a bit.
Figure 36:
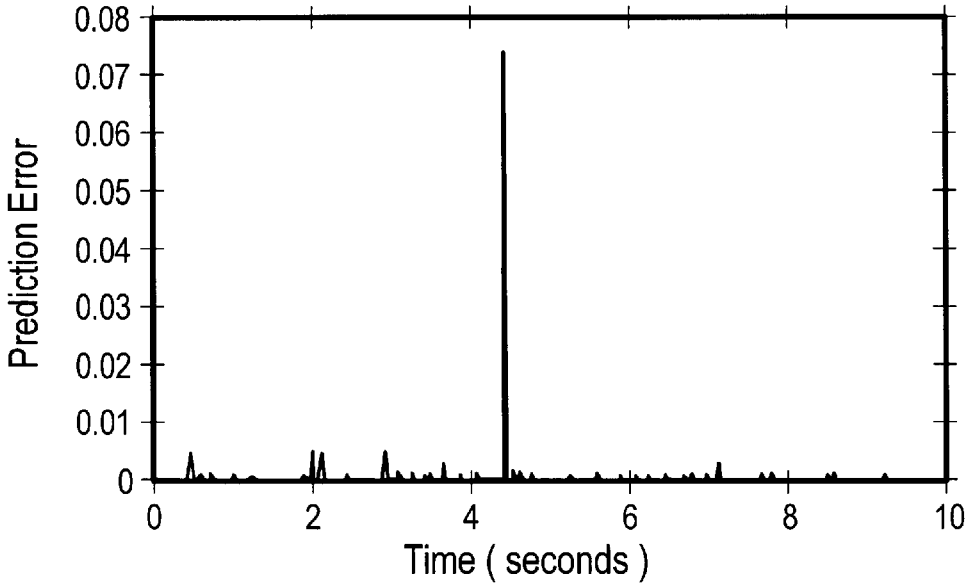
FIG. 36 shows acceleration prediction error for a bearing with no damage.
Figure 37:
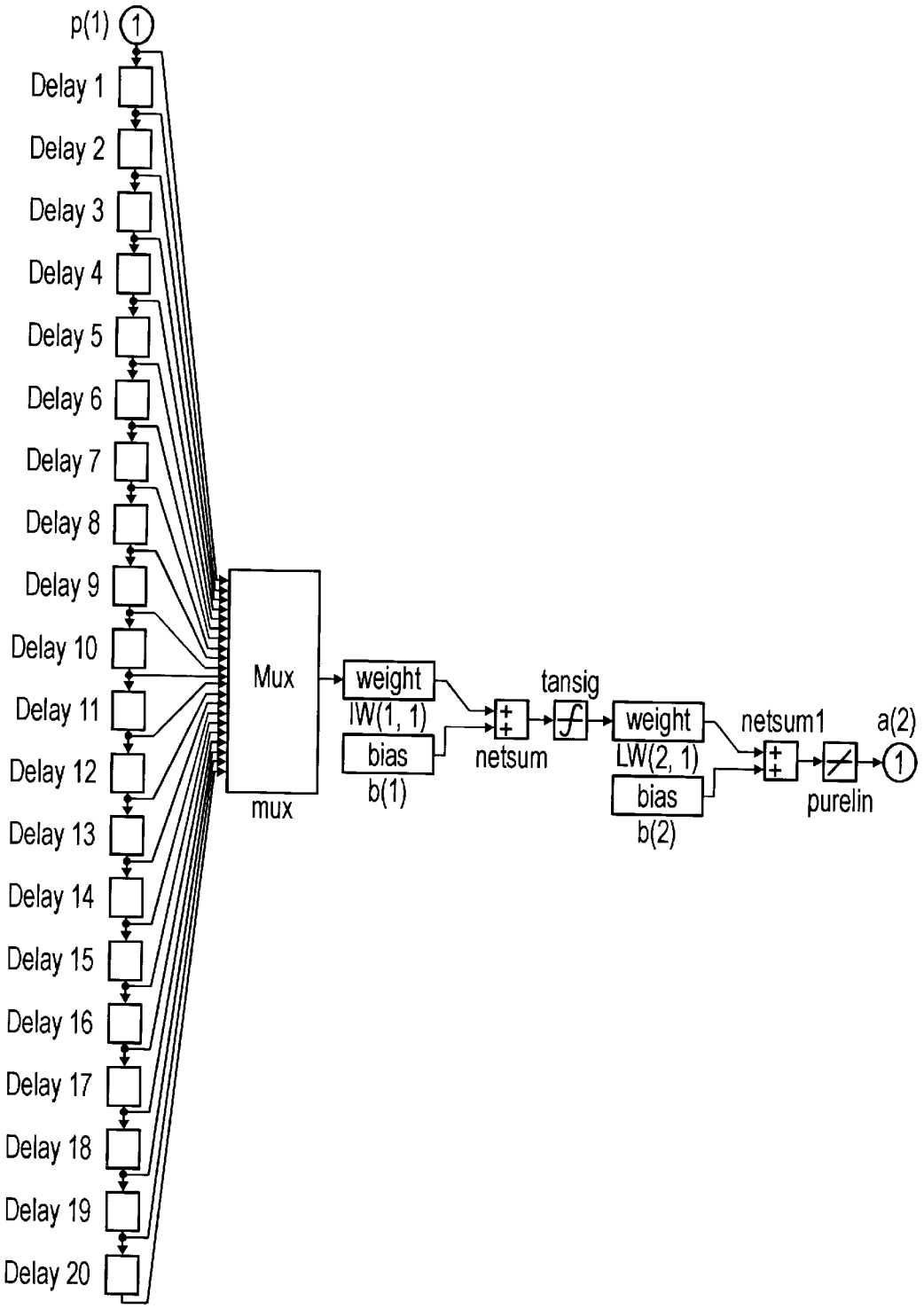
FIG. 37 shows a matlab simulation of an example neural net.

An IADC class 117W 12¼" XP-7 bit was used for all tests. The test procedure consisted of flushing the number 3 bearing with solvent to remove most of the grease and then running the test bit with a rotational speed of 60 rpm and a constant load of 38,000 pounds. Cooling fluid was pumped over the bit throughout the test. Under these drilling conditions the contamination level in the number three bearing was increased in steps. This process continued until the number 3 bearing was very hot, and was beginning to lock up. Baseline data with the bit in good condition and the bearing at a low temperature was taken before any contamination was introduced to the bit. A section of this data is shown in FIG. 35. FIG. 36 shows the filter prediction error produced by the adaptive filter shown in FIG. 37.

A variation of the Levenberg-Marquart algorithm was used to train the network. As FIG. 36 reveals, the prediction error was very small when there was no bearing damage.

Figure 38:
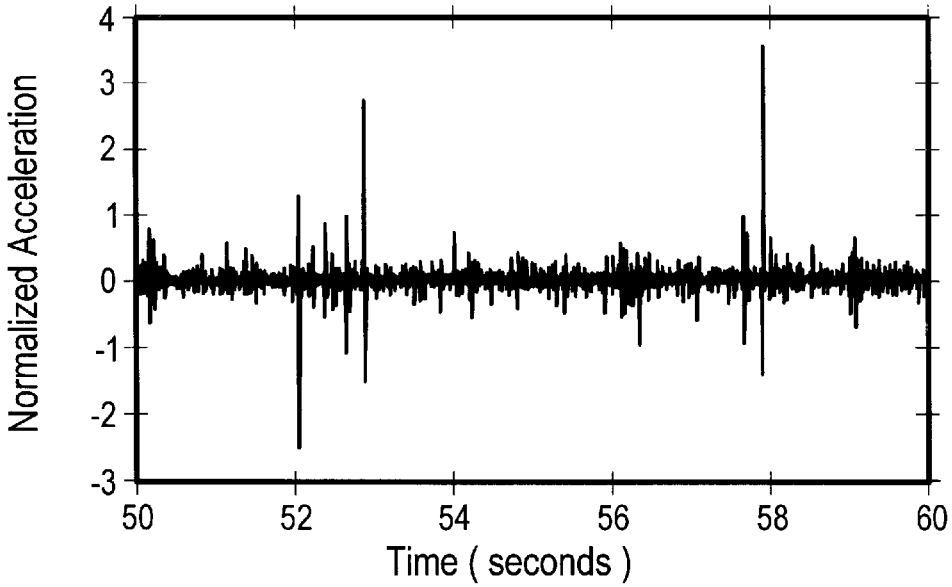
FIG. 38 shows acceleration data for a bit with light bearing damage.
Figure 39:
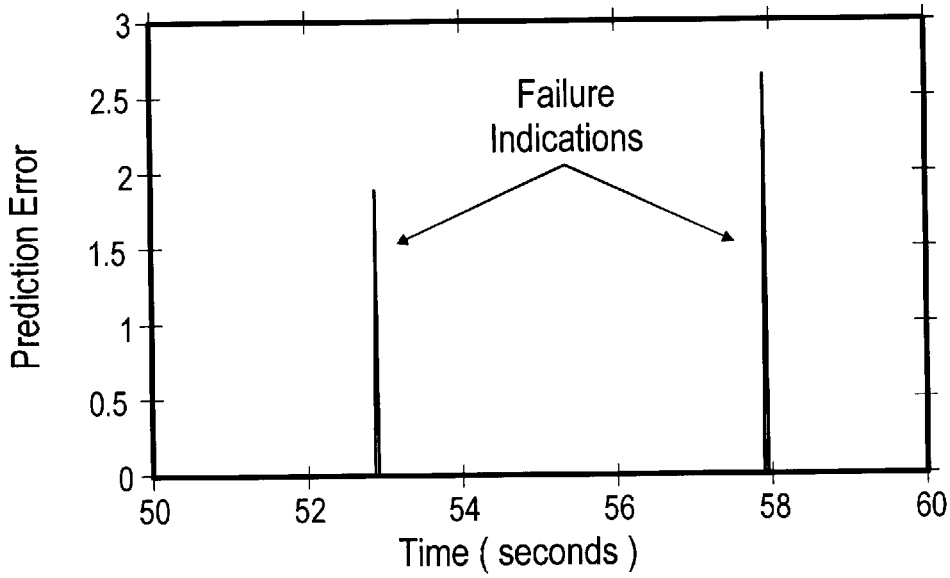
FIG. 39 shows acceleration prediction error.

Testing continued for several hours. Twice during the test a drilling mud mixture consisting of 1.4 liters of water, 100 grams of bentonite and 1.1 grams of sodium hydroxide was pumped into the number 3 bearing area. After the addition of the mud and after extended drilling some bearing failure, occasional "spikes" in the accelerometer data indicated early bearing failure. FIGS. 38 and 39 show accelerometer data and the corresponding adaptive filter prediction error.

Figure 40:
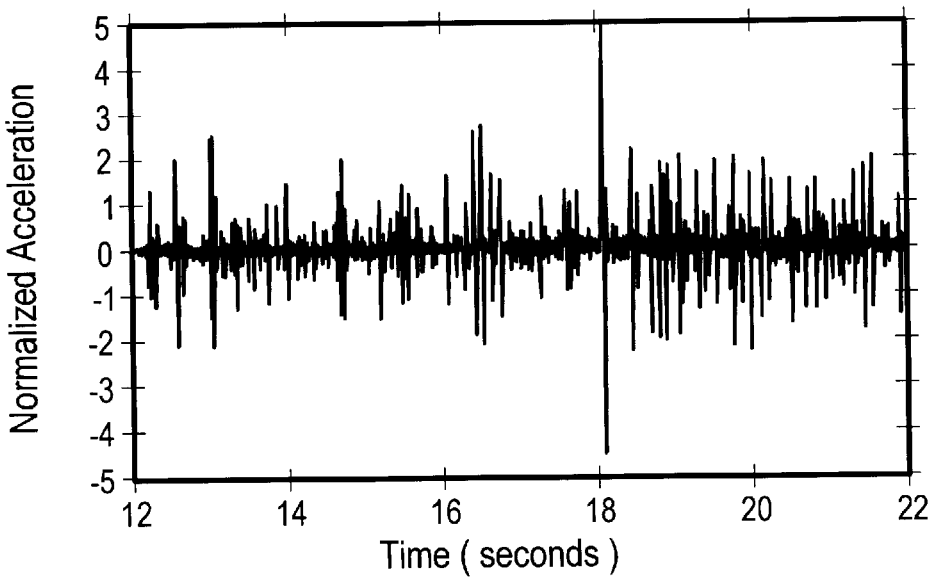
FIG. 40 shows acceleration data for a bit with moderate bearing damage.
Figure 41:
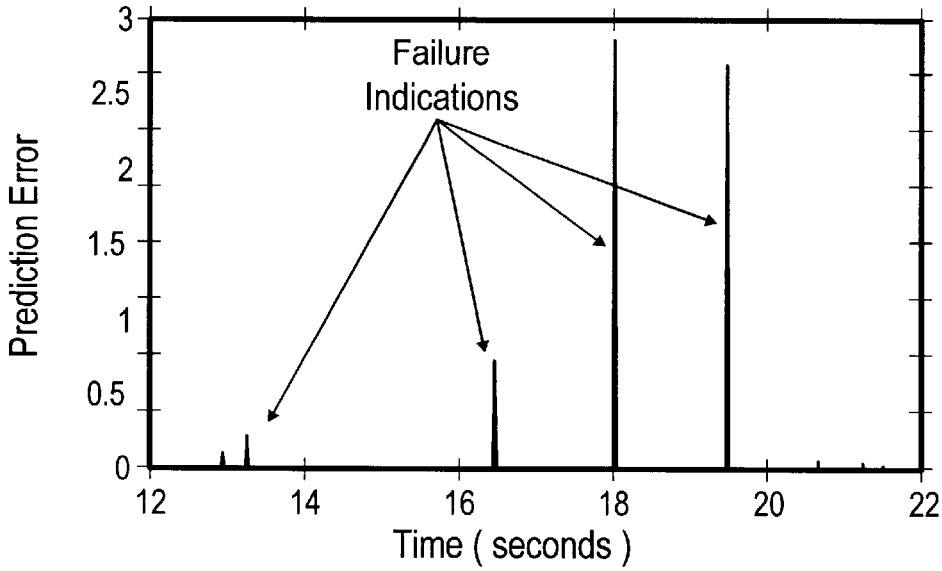
FIG. 41 shows acceleration prediction error.

In the last phase of the test drilling was halted and a solution of 1.4 liters of water, 100 grams of bentonite, 1.1 grams of sodium hydroxide, and about a gram of sand was pumped into the number 3 bearing area. Drilling resumed, and the bearing quickly began to show signs of increasing failure. The number 3 bearing began to produce steam as it heated up. FIGS. 40 and 41 show the accelerometer data and prediction results for the data recorded under these conditions.

Figure 42:
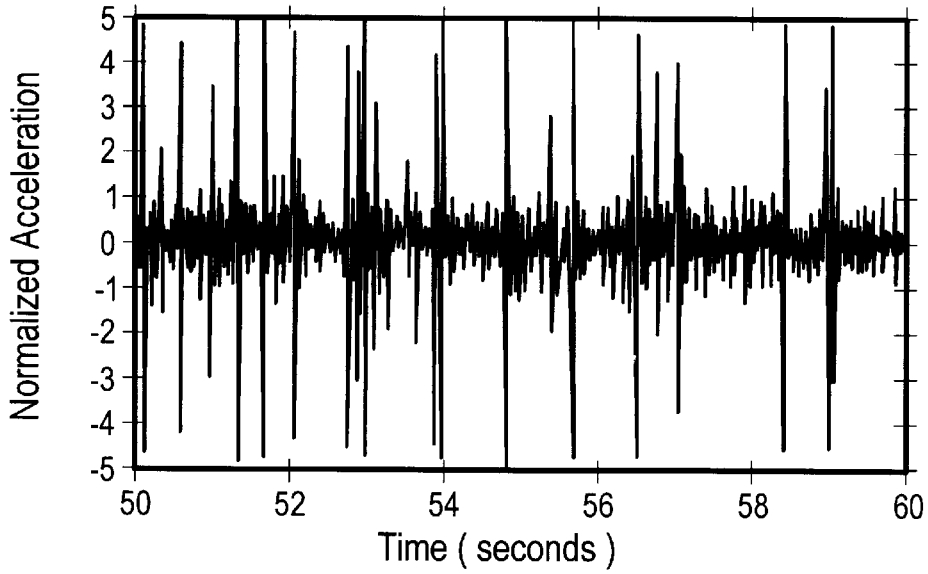
FIG. 42 shows acceleration data for a bit with heavy bearing damage.
Figure 43:
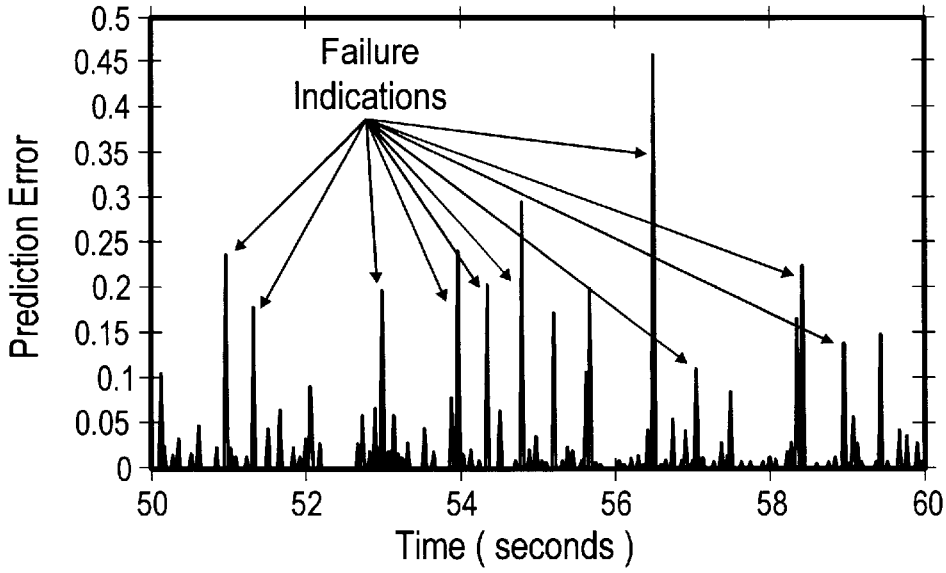
FIG. 43 shows acceleration prediction error.

The last test data was recorded after significant bearing wear. This data was recorded just prior to bearing lockup. The "squeaking" in the bearing is obvious in FIG. 42. Numerous failure indications can be seen in FIG. 43 which is a plot of the adaptive filter prediction error. It must be noted that the "slop" in the number 3 bearing is still very small. This means that a very definite failure detection was indicated long before catastrophic bearing separation.

Downhole Power Generation Using BRA Vibration

The innovations in this application have unique operating requirements, which makes the use of vibration as a power source an attractive option. For instance, we know that we will always be starting out with a reasonably good bit. This means that there will always be sufficient time to "charge" the power system in the tool before failure detection is required. In other words we know that we will always have the opportunity to drill for a sufficiently long period of time prior to bearing failure that the detection electronics will be charged and running when a failure occurs. The detection electronics will not have to be run continuously so that power consumption will be inherently low. Another factor which may make it possible to use vibration as a power source, is the fact that in this application there is a high ambient vibration level.

Figure 44:
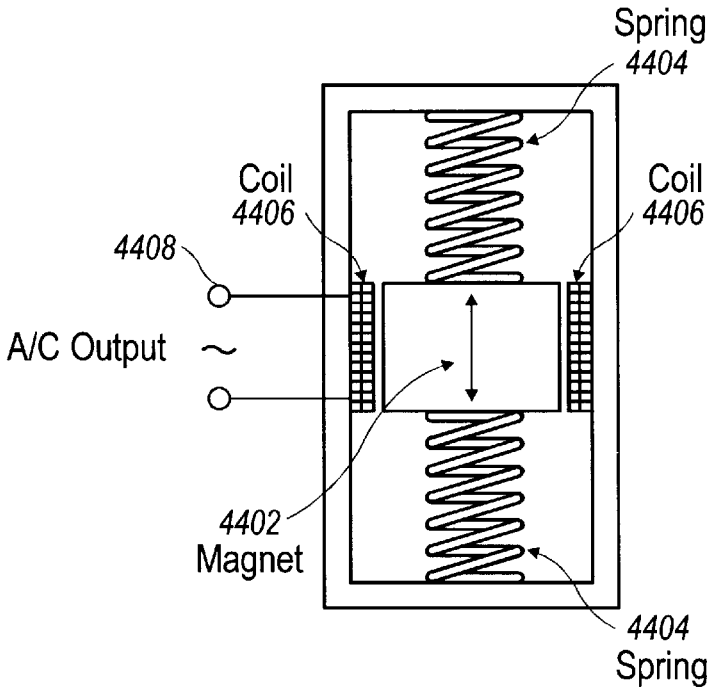
FIG. 44 shows a coil power generator.

A miniature, scaled down prototype vibration-based power generator was designed and built. This unit was "strapped" to the bit assembly during one of the bit tests. The device contains a coil magnet pair in which the magnet is supported by two springs such that it may vibrate freely in the axial direction. As the magnet moves relative to the coil, current is generated in the coil. FIG. 44 depicts the device schematically. The magnet 4402 is supported by two springs 4404 at top and bottom. The magnet is surrounded by a conducting coil 4406, which is connected to external contacts 4408 for the output.

The magnet and springs constitute a simple spring-mass system. This system will have a resonant natural frequency of vibration. For successful operation the mass of the magnet and the spring rate for the supporting springs will be selected so that the resonant frequency of the assembly will fall within the band of highest vibration energy produced by the bit. Test data indicates that this will occur somewhere between 1 and 400 Hz. Matching the resonant frequency of the spring-magnet assembly to the highest magnitude BHA vibration will cause the greatest motion in the generator and hence, the largest level of power generation will occur under these conditions. The. AC power produced by the generator must be rectified and converted to DC for use in charging a power storage device or for direct use by the electronic circuitry. The basic idea is to have a small (short duration) power storage device which "smoothes" and extends power delivery to the electronics for short periods of time when vibration levels are low. If drilling operations are suspended for a long enough period of time, the power will be exhausted and the electronics will shut down. When drilling resumes, the power storage device will be recharged, the electronics will restart, and the failure detection process will resume.

Figure 45:
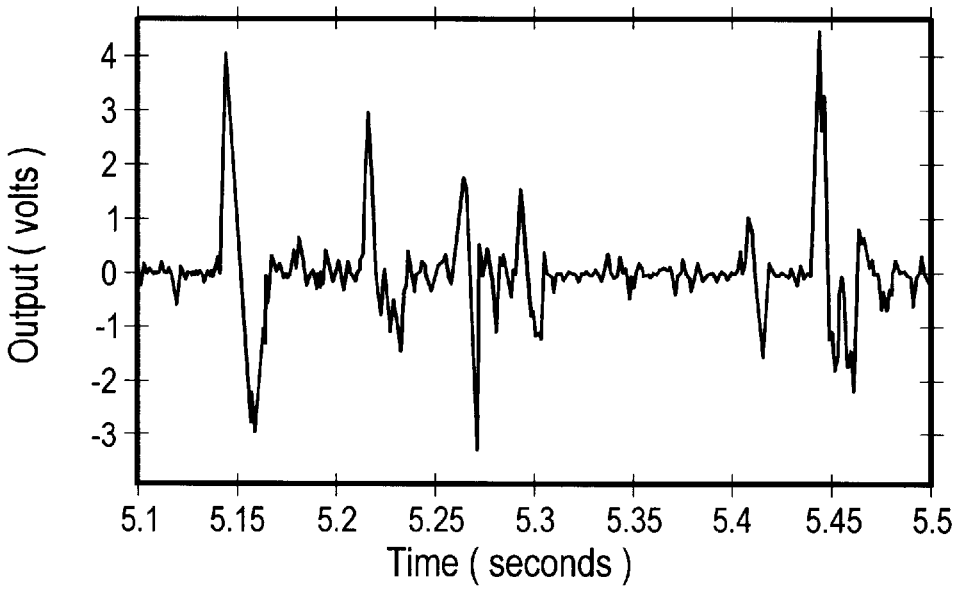
FIG. 45 shows the power generator output.

Test results show that this type of device can be used to generate reasonable power levels. FIG. 45 shows a plot of the prototype power generator output over a short period of time. A 1000Ω resistor was used as a load element.

It must be noted that the test unit was not "tuned" for optimum use in the vibration field produced by the drilling test, so performance was fairly low. A quick calculation can be made that shows the peak power output represented in FIG. 45 is approximately 16 mw, with an average power of approximately 1 mw. A larger, properly tuned generator could produce a great deal more power.

Downhole Tool and Warning System Description

In this section a method and apparatus for signaling the operator at the surface is described. Under normal rotary drilling operations surface pump pressure is applied to the drill string which creates a high-pressure jet via nozzles in the drill bit. This is also true when drilling is performed using a mud motor. A large pressure drop is present across the nozzles in the bit. For example, a pump pressure of 2500 psi might be applied to the drill string at the surface. This applied pressure will be seen at the bit, minus fluid friction and other pressure losses. So the flowing pressure drop across the bit might be around 1200 psi. If a non-restrictive port is opened above the bit, the flowing pressure within the entire system will be reduced. In other words, if a large port is opened above the bit, the 2500 psi applied at the surface will drop to say 1800 psi. This pressure drop can be used as a signal to the operator that the port has opened indicating a particular condition downhole such as a bearing failure.

Figure 46:
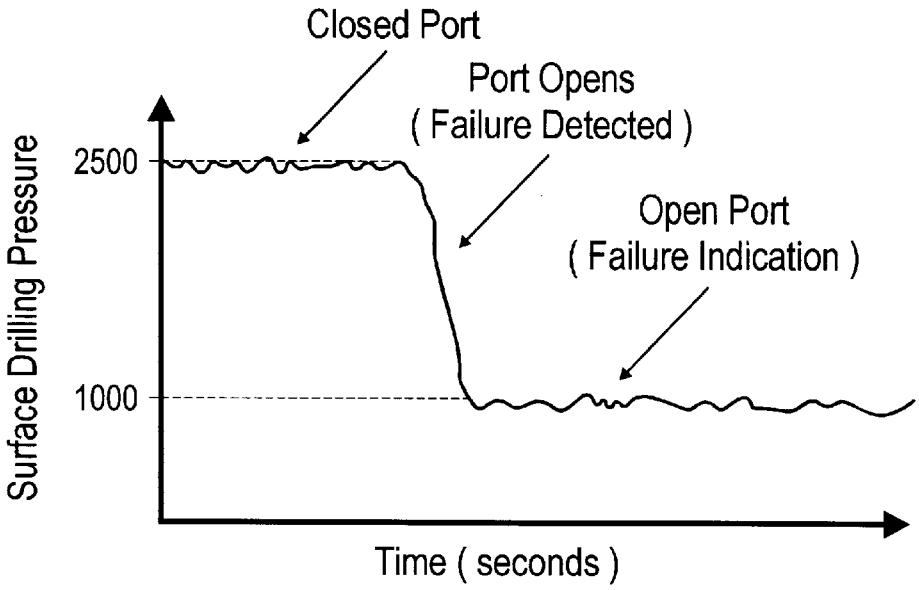
FIG. 46 shows an example of an open port failure indication.
Figure 47:
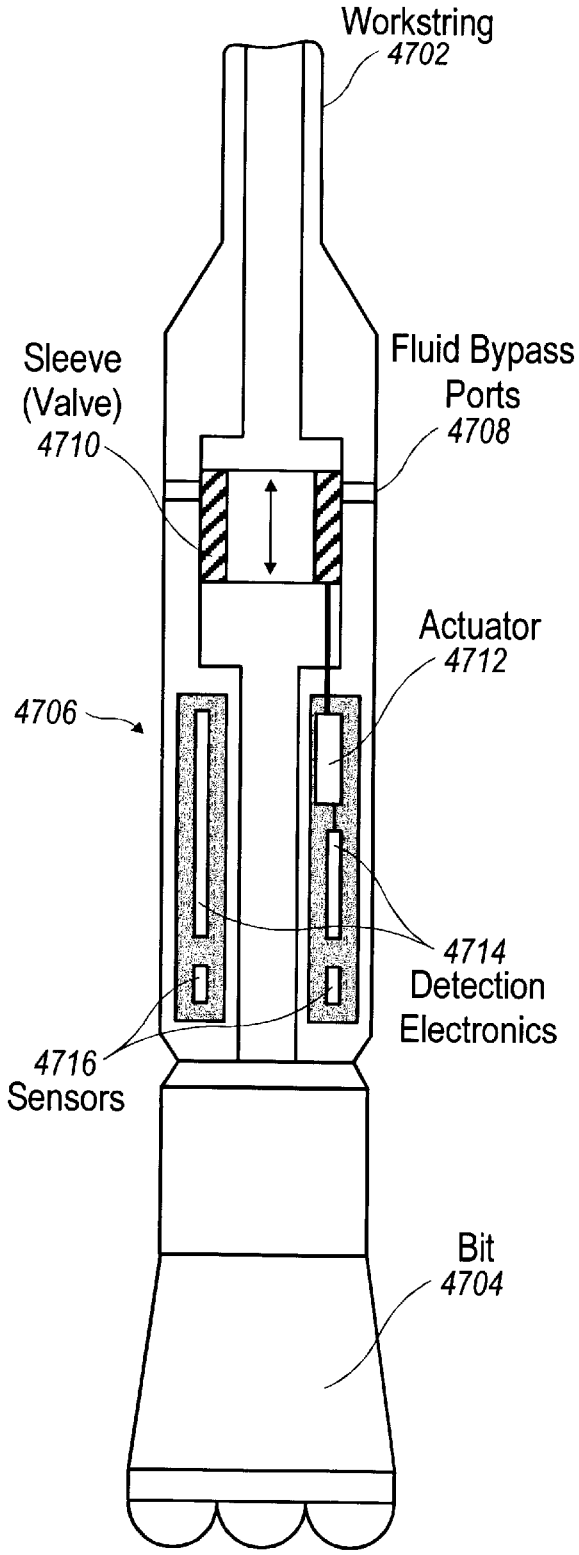
FIG. 47 shows a downhole tool schematic.

In the example embodiment of FIG. 46, the basic detection/warning system operation follows a sequence. First the sensor data is monitored while the drilling operation proceeds. The detection method previously described is used to detect a failure in progress. If a failure is detected a port is opened which causes a drop in the surface pump pressure. This drop in pressure can easily be seen by the surface operator, serving as a warning that a failure is in progress in the bit. A schematic of the downhole tool apparatus is shown in FIG. 47. The workstring 4702 contains a fluid passage which allows fluid to reach the drill bit 4704, passing through the instrumented sub 4706. The sub 4706 includes a fluid bypass port 4708 and a sleeve 4710 or valve which opens or closes the fluid bypass port 4708. An actuator 4712 is connected to both the sleeve 4710 and the detection electronics 4714. Sensors 4716 are also located in the sub 4706 (in this embodiment).

Figure 48:
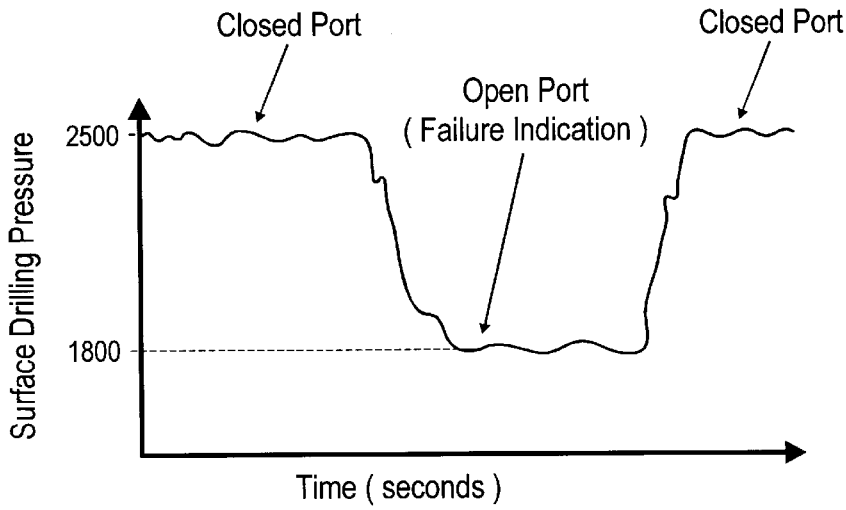
FIG. 48 shows a closed-open-closed port signal.

In this embodiment a sleeve valve can be opened and closed repeatedly to cause corresponding low and high pressure pumping pressure levels at the surface. A microprocessor or digital signal processor is used to implement the detection algorithm and monitor the sensors. Additionally the processor will control the actuator, which opens and closes the sleeve valve. Of course any valve type could be used. It may be desirable in some cases to close the bypass valve after a certain delay, so normal drilling can proceed if desired. FIG. 48 shows the surface pressure sequence associated with this type of operation.

In another embodiment a "one-shot" pilot valve is used to initiate a fluid metering system which lets the sleeve valve slowly meter into the open position, then continue into the closed position for normal drilling to resume. This type of design will be much less complex than a system with a multiple open and close capability. Likewise, another intermediate state can be added to such a mechanism, so the pressure drop appears to go through two stages before returning to normal pressure.

Figure 49:
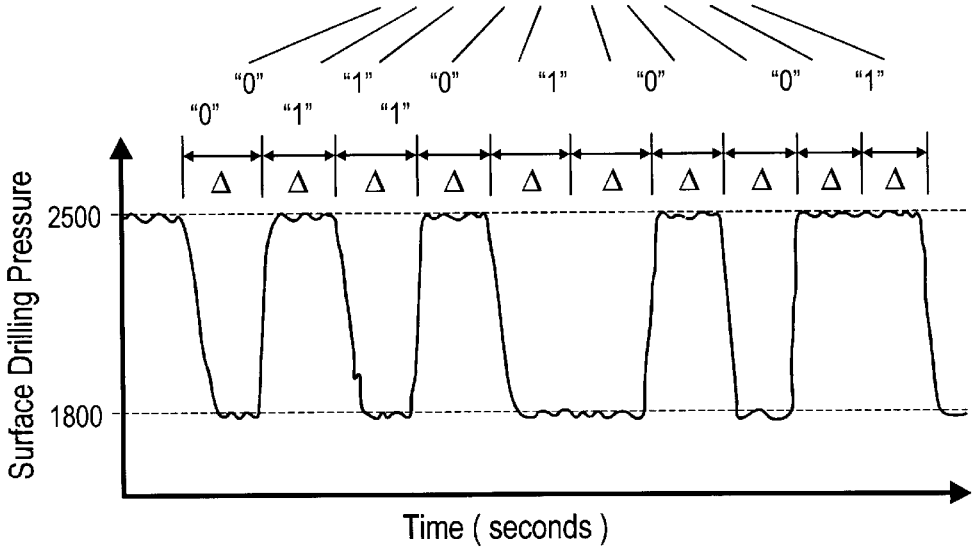
FIG. 49 shows an example of binary data transmission using static pressure levels.

The signaling idea just described can be extended to binary data transmission. In this embodiment the sleeve valve is used to "transmit" binary encoded data by alternately shifting between open and closed valve positions thereby causing corresponding low and high surface flowing pressures which can be observed at the surface. The type of information to be transmitted could be of any type. For instance, bit condition ratings, pressures, temperatures, vibration information, strain information, formation characteristics, stick-slip indications, bending, torque and bottom hole weight-on-bit, etc, could be transmitted. FIG. 49 illustrates this transmission scheme. This type of transmission is different that standard mud-pulse technology which is used in MWD systems. The difference lies in the fact that static pump pressure levels are monitored rather than transient acoustic pressure pulses. This type of transmission will be much slower than mud-pulse telemetry systems, but is suitable for low tech, low cost settings where complex and expensive surface receivers are not economically practical. Of course, the detection schemes described herein are suitable for integration into a full-blown MWD system as well.

Differential Sensor Method

In the preferred embodiment, the sensors in the instrumented sub are used to detect downhole drill bit failure. This innovation can be implemented by monitoring a downhole sensor close to each of the bearings and performing a cross-comparison between the sensor measurements. Sensor measurements might include temperature, acceleration, or any other parameter that will be affected by a bearing or bit failure. If a change in the difference between one of the bearing sensors and the other two exceeds a threshold value, a failure is indicated. If a failure is detected, a mechanism that alters the hydraulic characteristics of the bottom hole assembly is activated, indicating the failure on the surface.

An absolute sensor measurement is not used to determine a failure in progress. A measurement relative to each of the other sensors is used. This scheme eliminates concerns about unknown ambient conditions accidentally causing a false failure detection or a missed failure detection. This means that the system is self-calibrating so a sensor threshold is set as a relative measurement rather than an absolute sensor measurement which is subject to change during the different drilling conditions, depths, fluid temperatures, and other variables.

Figure 50:
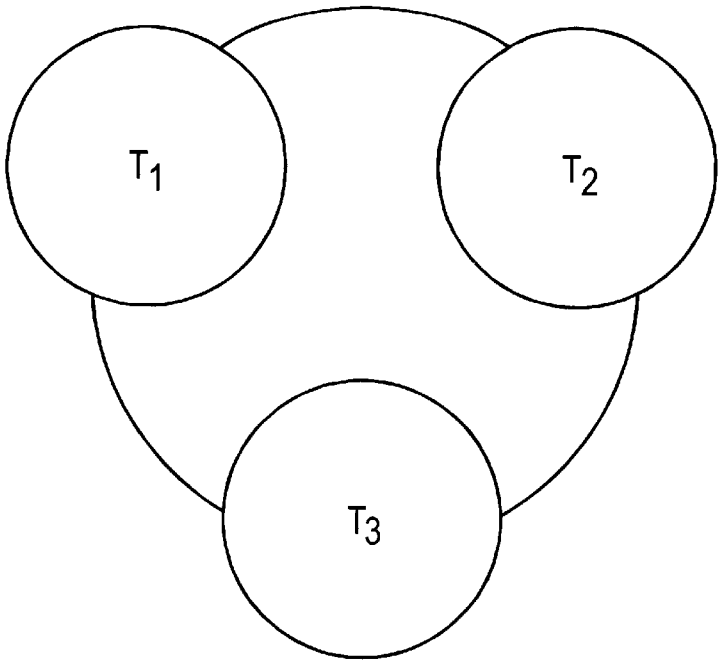
FIG. 50 shows an example of sensor placement on a bit.
Figure 51:
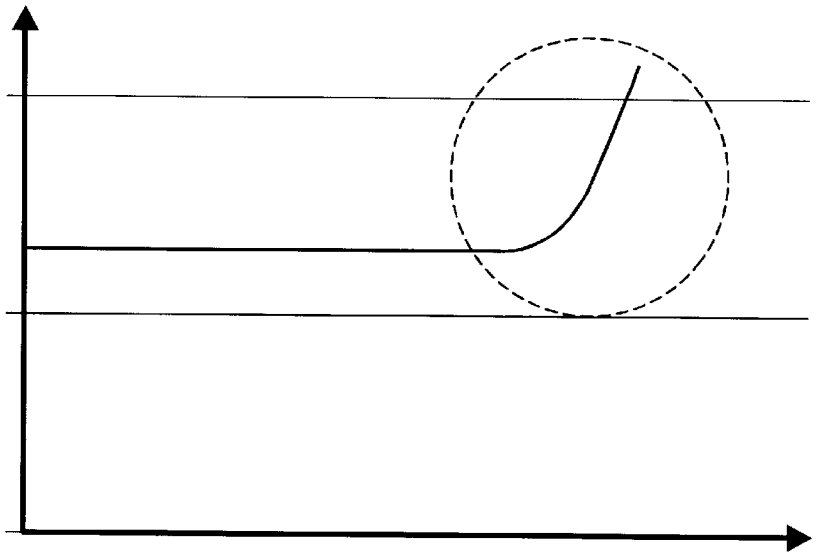
FIG. 51 shows an example failure indication with differential sensor measurements.

FIG. 50 shows a possible placement of sensors on the drill bit, with the sensors labeled T1–T3. In this example, the sensor placement is symmetric, but it need not be symmetric in other embodiments. The innovative differential sensor measurement scheme is shown graphically in FIG. 51. Three signals are shown as the lines labeled T1–T3. At a failure, one of the signals undergoes a change with respect to the others, indicating the failed condition. This condition is relayed to the surface to the operator.

Definitions

Following are short definitions of the usual meanings of some of the technical terms which are used in the present application. (However, those of ordinary skill will recognize whether the context requires a different meaning.) Additional definitions can be found in the standard technical dictionaries and journals.

BRA: Bottom Hole Assembly (e.g. bit and bit sub).

Telemetry: Transmission of a signal by any means, not limited to radio waves.

Transform: A mathematical operation which maps a data set from one basis to another, e.g. from a time domain to or from a frequency domain.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

Two types of detection scheme can be combined to give warnings at different times, depending on how each individual scheme detects failure. Some detection methods present failure evidence at an earlier time during the failure process than other schemes. Combining two schemes (an early detection and a later detection scheme) will allow the operator to know when a failure first begins, and when that failure is imminent. This information can be useful, for example, so that a bit is fully used before it is removed from a hole, or in data gathering for fine tuning other detection schemes.

The valves used to alter the downhole pressure mentioned herein can be one-way valves, or (in some embodiments) valves capable of both opening and closing. In the most preferred embodiment the valve cycles through an irreversible movement which includes both open and closed positions, e.g. from a first state (e.g. closed) to a second state (e.g. open) and on to a third (closed) state, at which point the valve is permanently closed. (This can be implemented mechanically by a sleeve valve in which fluid pressure from mud flow cooperates with an electrical actuator to move the valve through its states, but does not permit the valve to reverse its movement.) Alternatively, the valve can be designed with a reversible movement from a first state (e.g. closed) to a second state (e.g. open) and back to the first (closed) state. This allows normal drilling to proceed even after a failure is indicated by the system. Such post-warning drilling may be necessary to obtain the full use of the bit, especially in a scheme that uses two detection schemes. For example, an early detection scheme (such as the spectral power ratio analysis method) can advantageously be used in combination with a late detection scheme (such as the mean strain ratio analysis method).

The placement of the strain gauges need not be symmetric about the sub, nor must they match the journal arms. Non-orthogonal or non-symmetric gauge placement, especially when coupled with the relative sensor reading self-calibration, can be employed within the concept of the present innovations.

Spectral and other types of analysis of the sensor data can be used. The data may be transformed in a number of possible ways to pick out a particular signal from the readings. For example, the AC component of the gauge readings can be separated from the total readings and analyzed separately, or in concert with other data.

In time series data, an intermediate point can be estimated rather than simply predicting a future data point. Having data points from before and after a data point to be estimated (rather than predicted) can be advantageous, for example, in reducing prediction error under extremely noisy conditions.

The methods herein described are depicted as being used to detect catastrophic failure, but other conditions of downhole equipment can also be detected. For example, the characteristics of the sensor data may also indicate mere wearout rather than imminent catastrophic failure.

Though the example embodiments herein described use ratios of energy or power to make their predictions or estimations, other functions can be used, such as peaks, envelope tracking, power, energy, or other functions, including exponentially weighted functions.

The term acoustic is used to describe the data monitored by several embodiments. In this context, acoustic refers to a wide range of vibrational energy. Likewise, the acoustic data need not necessarily be gathered by sensors on the downhole assembly itself, but could also be gathered in other ways, including the use of hydrophones to listen to vibrations in the fluid itself rather than just bit acoustics. Strain gauges can also be sampled at acoustic rates or frequencies.

As mentioned, strain gauge placement can vary with the application, including single or multiple axis placement.

Different types of transforms (other than the examples mentioned like fast Fourier transforms) can be used to analyze the data from the sensors. For example, various filters can be used to separate the sensor data into different frequency bands for analysis. Likewise, the data can be transformed into other domains than frequency. Though fast Fourier transforms are depicted in the described embodiments, other kinds of transforms are possible, including wavelet transforms, for example.

Though in some applications of the present innovations the sensor placement may necessarily be near the drill bit itself to collect the relevant data, this is not an absolute restriction. Sensors can also be placed higher up on the drill string, which can be advantageous in filtering some kinds of noise and give better readings in different drilling environments. For example, sensors can be placed above the mud motor, or below the mud motor but above the bit.

Though the signaling embodiments disclosed herein for notifying the operator of the sensor calculations and/or results prefer a reduction of mud flow impedance (i.e. opening a valve from the drillstring interior into the well bore) over a restriction of mud flow (closing a vlavle), restriction of mud flow is a possible method within the contemplation of the present innovations.

The choke or valve assembly used to vary mud flow or mud pressure can be of various makes, including a sliding sleeve assembly that reversibly or irreversibly moves from one position to another, or a ball valve which allows full open or partially open valves. Valve assemblies with no external path (which can allow infiltration into the interior system) are preferred, but do not limit the ideas herein.

At least some of the disclosed innovations are not applicable only to roller-cone bits, but are also applicable to fixed-cutter bits.

The adaptive algorithms used to implement some embodiments of the present innovations can be infinite impulse response, or finite impulse response. In embodiments which employ neural networks as adaptive algorithms, infinite impulse response implementations tend to be more common.

Additional general background, which helps to show the knowledge of those skilled in the art regarding the system context, and of variations and options for implementations, may be found in the following publications, all of which are hereby incorporated by reference: HAGAN, DEMUTH, and BEALE, Neural Network Design, PWS Publishing Company, 1996, ISBN 0-534-94332-2; LUA and UNBEHAUN, R., Applied Neural Networks for Signal Processing, Cambridge University Press, 1997.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A system for monitoring drill bit performance, comprising:

a drill string mechanically connecting a drill bit to the surface; and a sub assembly on the lower end of said string above said drill bit;

wherein said sub assembly includes one or more sensors, and circuitry which processes the output of said one or more sensors to detect and signal failing of the drill bit, without relying on sensors in the drill bit.

2. The system of claim 1, wherein said circuitry comprises an adaptive neural network.

3. The system of claim 1, wherein said sensors measure axial strain.

4. The system of claim 1, wherein said sensors measure vibrational frequency.

5. The system of claim 1, wherein drill bit failure is signaled to a surface operator.

6. A system for monitoring drill bit performance, comprising:

a drill string mechanically connecting a drill bit to the surface;

a sub assembly on the lower end of said string above said drill bit;

a detection platform on said sub assembly which receives data from one or more sensors;

wherein said sub assembly is connected to predict and signal failure of the drill bit, without any connection to sensors in the drill bit.

7. The system of claim 6, wherein said sub assembly predicts failure using an adaptive neural network.

8. The system of claim 6, wherein said sensors measure axial strain.

9. The system of claim 6, wherein said sub assembly predicts failure by monitoring relative changes in data collected by said sensors.

10. The system of claim 6, wherein drill bit failure is signaled to a surface operator.

11. A method of operating a drill rig, comprising the steps of:

monitoring a signal transmitted from a downhole instrumented sub assembly, said sub assembly having no electrical communication with sensors in an attached drill bit, and said sub assembly having at least one sensor thereon;

halting drilling when said signal indicates an impending failure condition.

12. The method of claim 11, wherein said at least one sensor measures axial strain.

13. The method of claim 11, wherein sensor data is analyzed by an adaptive math model.

14. The method of claim 11, wherein said sub assembly has no electrical communication with said attached drill bit.

15. The method of claim 11, wherein said signal is transmitted to the operator by varying the pressure of drilling mud.

16. A method of operating a drill rig, comprising the steps of:

on a drill string having a drill bit, monitoring a signal transmitted from one or more downhole sensors, said sensors located on a sub assembly which has no electrical communication with sensors in said drill bit;

taking a predetermined action when said signal indicates a change in downhole equipment conditions.

17. The method of claim 16, wherein said predetermined action is to halt normal drilling.

18. The method of claim 16, wherein said step of monitoring is performed by an adaptive filter located on said sub assembly.

19. The method of claim 16, wherein said sub assembly has no electrical communication with said drill bit.

* * * * *